US009617111B2

(12) United States Patent
Hoover

(10) Patent No.: US 9,617,111 B2
(45) Date of Patent: Apr. 11, 2017

(54) YARN CREEL ASSEMBLY ADAPTED FOR CARRYING MULTIPLE INTERCONNECTED YARN PACKAGES IN A PLURALITY OF VERTICALLY SPACED PACKAGE STATIONS

(71) Applicant: American Linc, LLC, Gastonia, NC (US)

(72) Inventor: Donald Lynn Hoover, Clover, SC (US)

(73) Assignee: American Linc, LLC, Gastonia, NC (US)

( * ) Notice: Subject to any disclaimer, the term of this patent is extended or adjusted under 35 U.S.C. 154(b) by 81 days.

(21) Appl. No.: 14/424,772

(22) PCT Filed: Sep. 9, 2013

(86) PCT No.: PCT/US2013/058688

§ 371 (c)(1),
(2) Date: Feb. 27, 2015

(87) PCT Pub. No.: WO2014/039941

PCT Pub. Date: Mar. 13, 2014

(65) Prior Publication Data

US 2015/0225203 A1 Aug. 13, 2015

Related U.S. Application Data

(60) Provisional application No. 61/743,617, filed on Sep. 7, 2012, provisional application No. 61/755,083, filed on Jan. 22, 2013.

(51) Int. Cl.
*B65H 49/16* (2006.01)
*B65H 57/18* (2006.01)
(Continued)

(52) U.S. Cl.
CPC ..... *B65H 49/16* (2013.01); *B65H 49/12* (2013.01); *B65H 57/02* (2013.01); *B65H 57/04* (2013.01);
(Continued)

(58) Field of Classification Search
CPC ..... B65H 49/12; B65H 49/16; B65H 49/32; B65H 49/324; B65H 57/02; B65H 57/04;
(Continued)

(56) References Cited

U.S. PATENT DOCUMENTS 2,429,798 A 10/1947 Bradnack et al.
3,716,203 A 2/1973 Beasley
(Continued)

FOREIGN PATENT DOCUMENTS

GB 1208747 A * 10/1970 ..... B65H 49/16

*Primary Examiner* — William E Dondero
(74) *Attorney, Agent, or Firm* — Schwartz Law Firm, P.C.

(57) ABSTRACT

A yarn creel assembly includes a vertical frame, a plurality of vertically spaced package holders, and a vertically disposed arcuate yarn guide. The package holders are mounted on the frame and adapted for carrying respective yarn packages, whereby a tail end of a first yarn package is attached to a head end of a second yarn package. The arcuate yarn guide extends between adjacent package holders, and is adapted for guiding a moving end of yarn drawn from an emptying first yarn package and transitioning to a full second yarn package.

9 Claims, 30 Drawing Sheets

(51) Int. Cl.

| | |
|---|---|
| ***B65H 57/02*** | (2006.01) |
| ***B65H 57/04*** | (2006.01) |
| ***D01H 1/18*** | (2006.01) |
| ***B65H 49/12*** | (2006.01) |
| ***D04B 15/42*** | (2006.01) |
| ***D01H 13/04*** | (2006.01) |
| ***D02H 1/00*** | (2006.01) |

(52) U.S. Cl.
CPC ..... *B65H 57/18* (2013.01); *D01H 1/18* (2013.01); *D01H 13/04* (2013.01); *D02H 1/00* (2013.01); *D04B 15/42* (2013.01); *B65H 2701/31* (2013.01)

(58) Field of Classification Search
CPC ..... B65H 57/18; B65H 2701/31; D02H 1/00; D01H 1/18; D01H 13/04; D04B 15/42
See application file for complete search history.

(56) References Cited

U.S. PATENT DOCUMENTS

| | | | | |
|---|---|---|---|---|
| 3,915,406 | A * | 10/1975 | Rolli ..... | B65H 49/16 242/131 |
| 4,073,450 | A | 2/1978 | Carlsson et al. | |
| 4,666,098 | A | 5/1987 | Robinson | |
| 5,323,982 | A | 6/1994 | Ligon et al. | |
| 5,531,392 | A | 7/1996 | Weiner | |
| 8,177,154 | B1 | 5/2012 | Hoover | |
| 2005/0082404 | A1 * | 4/2005 | Beckmann ..... | D01H 13/04 242/129 |

* cited by examiner

YARN CREEL ASSEMBLY ADAPTED FOR CARRYING MULTIPLE INTERCONNECTED YARN PACKAGES IN A PLURALITY OF VERTICALLY SPACED PACKAGE STATIONS

TECHNICAL FIELD AND BACKGROUND OF THE INVENTION

This invention relates broadly and generally to a multiple station yarn creel assembly. In one exemplary embodiment, the creel assembly is designed to carry multiple vertically arranged yarn packages which are interconnected in series (e.g., head end of one package to tail end of another package, or tail end of one package to head end of another package), and which feed a single end of yarn from the interconnected packages to a downstream textile machine, such as a conventional heat-setting machine.

Conventional creels utilize yarn package supports which are arrayed on a plurality of support posts extending from a free standing frame of the creel and positioned so as to feed the yarn to the textile machine. Each of the yarn strands generally pass through various eyelets or other guides provided vertically and laterally throughout the creel. In the typical process, a pair of package supports are configured in alignment with each eyelet, and the respective yarn strands from the paired packages are tied or otherwise attached in series to alternately feed the process.

In systems utilizing manual loading methods, replacement of a yarn package in a creel typically requires a worker to remove a depleted package tube out of the creel from its working position to a loading position, then remove and dispose of a spent tube from the package holder, then lift the replacement yarn package from a delivery platform, then transport the package to the indicated package support, then manipulate the package to mount it on the package support, then rotate the replenished package support into the creel, and finally tie or otherwise secure the head end of the replenished yarn package to the tail end of the paired feeding yarn package. As can be readily seen, the operation and maintenance of a typical creel is and remains a labor intensive task.

In the exemplary embodiments described below, the present creel assembly may improve the efficiency and reduce the complexity of traditional creel operations. The present creel assembly may also function to reduce tension variation caused by ballooning as the yarn leaves the package.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a yarn creel assembly including a vertical frame, a plurality of vertically spaced package holders, and a vertically disposed arcuate yarn guide. The package holders are mounted on the frame and adapted for carrying respective yarn packages, whereby a tail end of a first yarn package is attached to a head (or lead) end of a second yarn package. The arcuate yarn guide extends between adjacent package holders, and is adapted for guiding a moving end of yarn drawn from an emptying first yarn package and transitioning to a full second yarn package.

The term "arcuate yarn guide" refers broadly herein to any structure designed to guide a running end of yarn in a substantially arcuate path.

A "full yarn package" refers broadly to any yarn package other than an empty yarn package—i.e., a package comprising any length of yarn wound on a bobbin or carrier.

According to another exemplary embodiment, the arcuate yarn guide defines a continuous slot having first and second end points.

According to another exemplary embodiment, the first end point of the arcuate yarn guide is located forward of and below the package holder.

According to another exemplary embodiment, a fixed-point yarn guide is located at the first end point of the arcuate yarn guide.

The term "fixed-point yarn guide" as used herein means any structure intended to guide, or temporarily hold, or direct the movement of yarn at a predetermined point.

According to another exemplary embodiment, the second end point of the arcuate yarn guide is substantially linearly aligned with a distal end of the package holder (in its 0-degree package ready position).

According to another exemplary embodiment, a fixed-point yarn guide is located at the second end point of the arcuate yarn guide.

According to another exemplary embodiment, the package holders reside in respective vertically arranged package stations, each package station being separated from an adjacent station by a substantially horizontally planar (e.g., continuous surface) station divider.

According to another exemplary embodiment, the station divider is substantially transparent.

According to another exemplary embodiment, each package holder is pivotably attached to the vertical frame, and adapted for movement between a 0-degree package ready position and a substantially 90-degree package replacement position. The term "substantially 90-degree replacement position" refers generally to a position pivoted outwardly from the 0-degree package ready position such that an emptied yarn package (bobbin/carrier) can be readily replaced with a full yarn package.

In another exemplary embodiment, the present disclosure comprises a yarn creel assembly including a vertical frame and a plurality of vertically arranged package stations. Each package station comprises an elongated package holder having a proximal end attached to the vertical frame and a distal end adapted for receiving and carrying a yarn package. A tail end of one yarn package in a first package station is attached to a head end of another yarn package located in a second package station. A substantially horizontal planar station divider is located between vertically adjacent package stations. A vertical wall is located adjacent the station divider, and is spaced apart from the distal end of the package holder. The vertical wall defines an arcuate yarn guide adapted for guiding a moving end of yarn drawn from an emptying yarn package in the first package station and transitioning to a full yarn package in the second package station.

According to another exemplary embodiment, the arcuate yarn guide comprises a continuous slot having first and second end points.

According to another exemplary embodiment, the first end point of the arcuate yarn guide is located forward of and below the package holder, and the second end point is located rearward of and above the first end point.

In yet another embodiment, the present disclosure comprises a method for carrying multiple yarn packages in an exemplary creel assembly described below.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY, EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
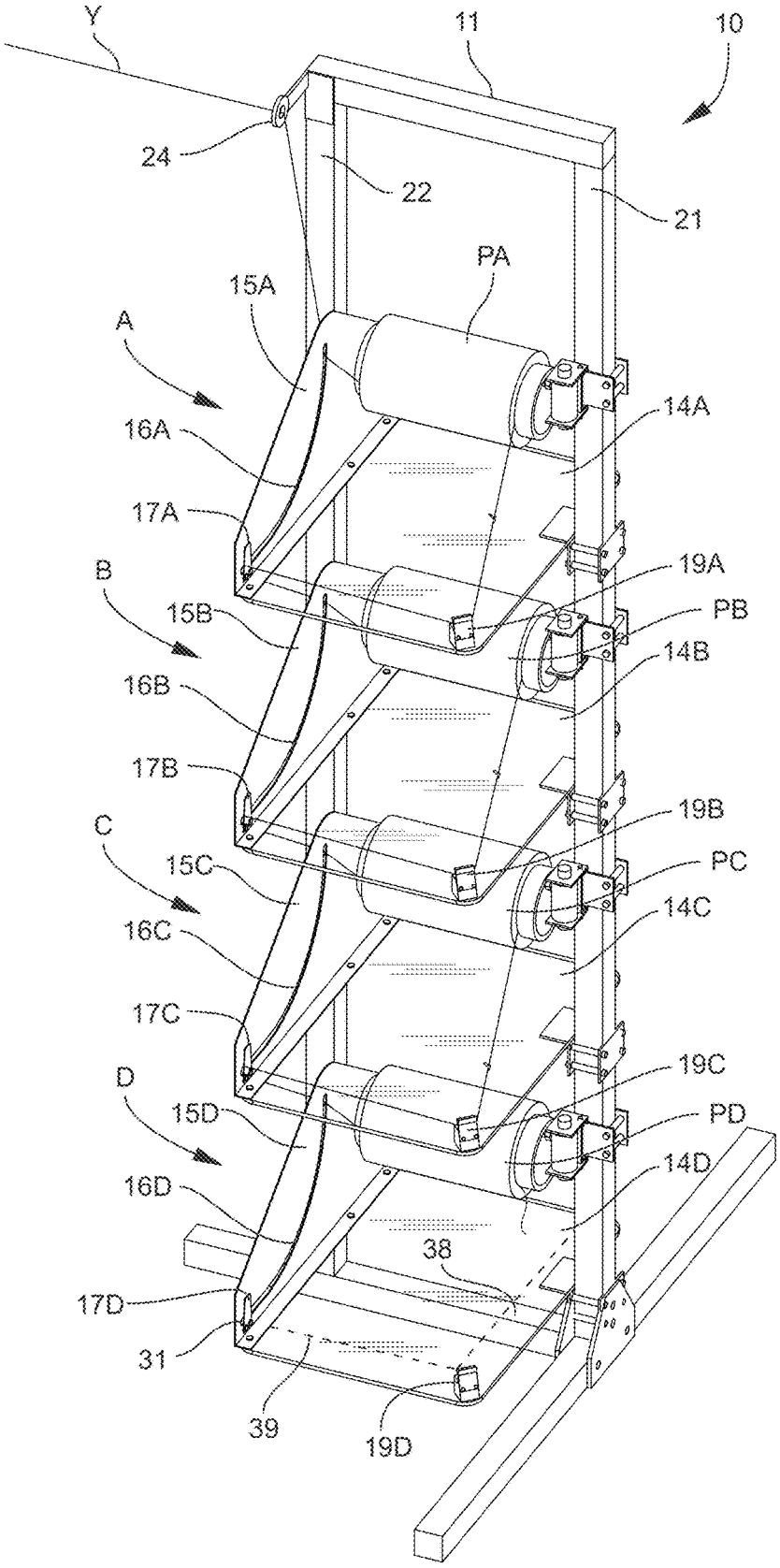
FIGS. 1 and 2 are perspective views of a multiple station yarn creel assembly according to one exemplary embodiment of the present disclosure.
Figure 2:
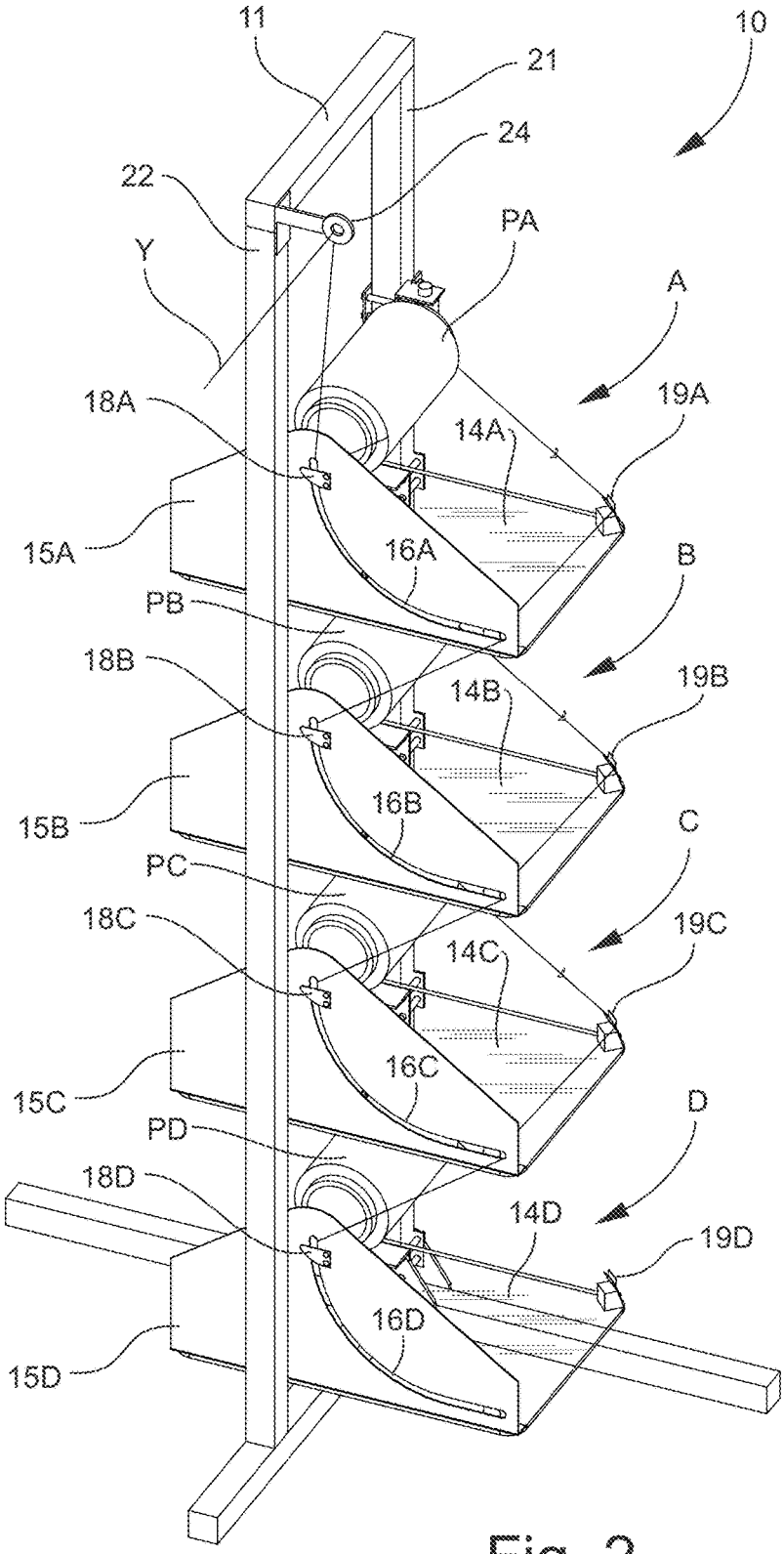
Figures 3, 3A:
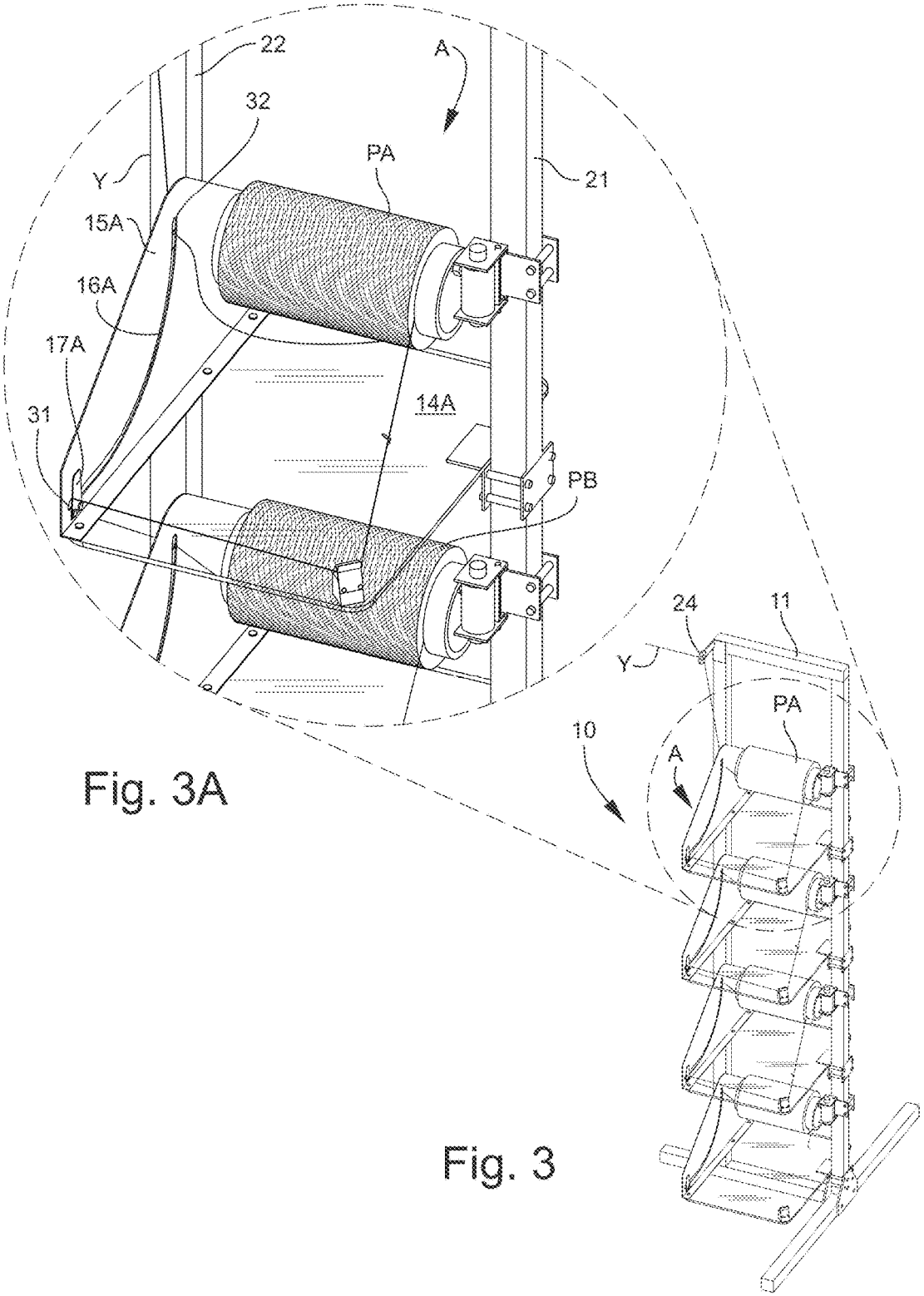
FIG. 3 is a further perspective view of the exemplary creel assembly.
FIG. 3A shows an enlarged fragmentary portion of the exemplary creel assembly.
Figure 10:
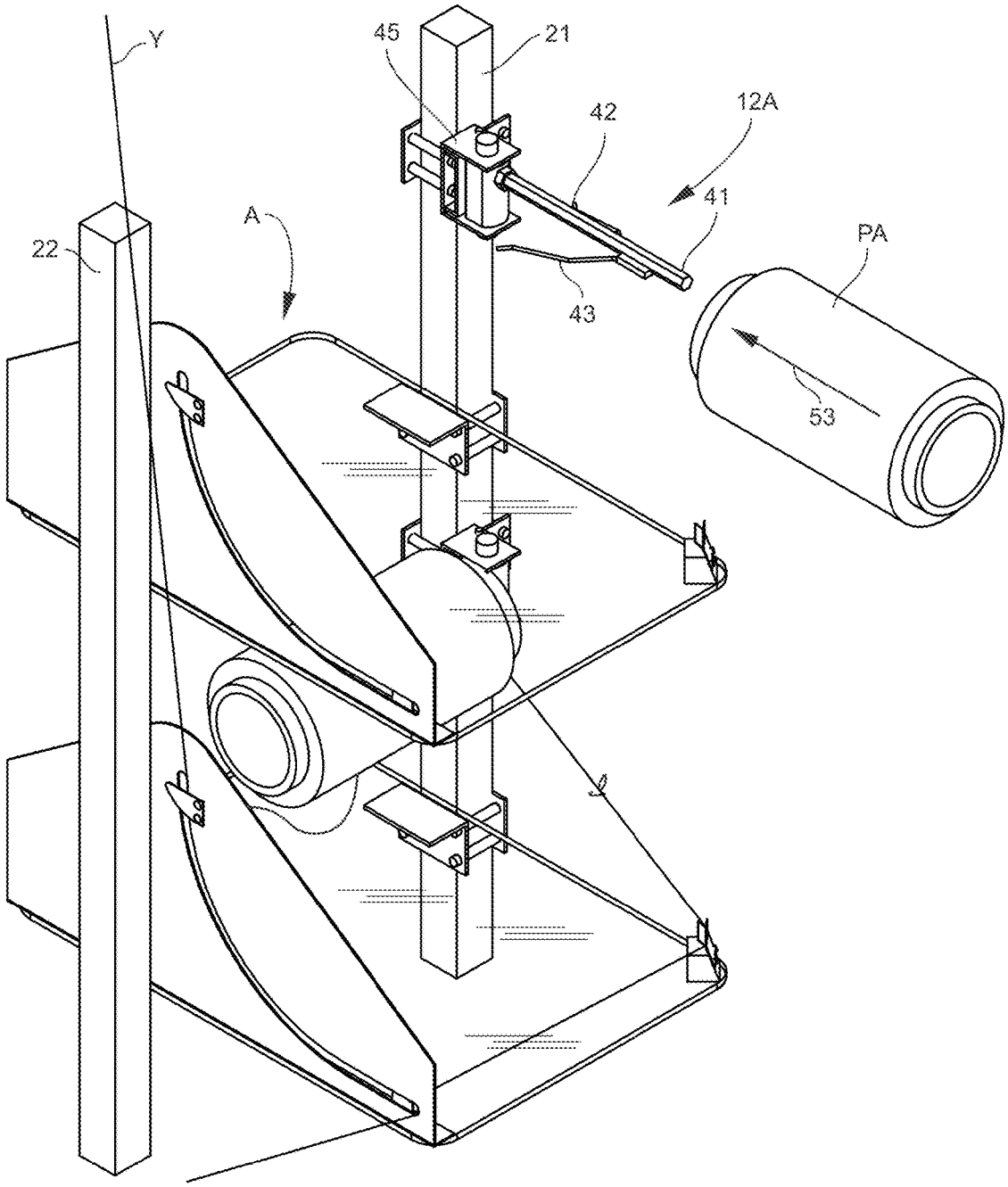
Figure 11:
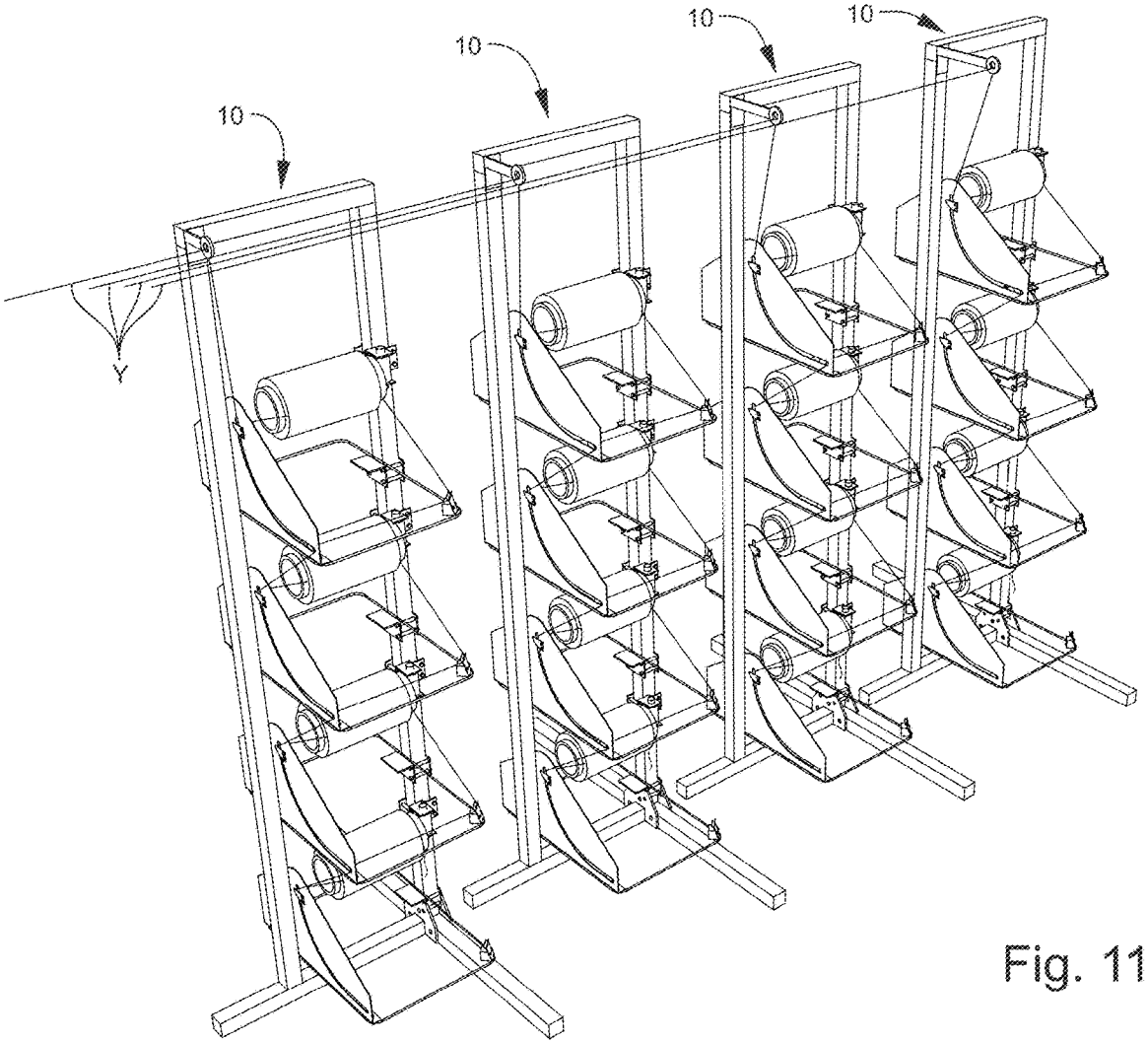
FIG. 11 is a further perspective view showing a side-by-side arrangement of multiple creel assemblies feeding respective yarn ends to a textile machine (not shown)

Referring now specifically to the drawings, a multiple station yarn creel assembly according to one embodiment of the present disclosure is illustrated in FIGS. 1 and 2, and shown broadly at reference numeral 10. The exemplary creel assembly 10 comprises vertically disposed package stations A, B, C, and D adjacent a vertical mounting frame 11 and carrying respective yarn packages PA, PB, PC, PD—each station A-D having a pivotably attached package holder 12A (See FIGS. 9 and 10; only one package holder 12A shown) a substantially transparent and horizontal station divider 14A-14D, a vertical side wall 15A-15D with arcuate yarn guide 16A-16D, and fixed-point yarn guides 17A-17D, 18A-18D, and 19A-19D. Package holders (not shown) in stations B-D are identical to package holder 12A. The package holder 12A and horizontal (planar) station divider 14A-14D are mounted on one vertical member 21 of the mounting frame 11, while the side wall 15A-15D resides just inside the opposite vertical member 22. As best shown in FIGS. 3 and 3A, a single end of running yarn "Y" passes through an overhead guide eye 24 attached to the mounting frame 11, and is drawn off the first yarn package PA in station-A. The tail end of the yarn package PA in station-A is tied to a head end of the yarn package PB in station-B, and the remaining yarn packages PC and PD attached tail-to-head in an identical manner described further below. Although 4 vertically arranged stations A-D are shown, it is understood that other exemplary embodiments the present creel assembly 10 may include any desired number of package stations including 2, 8, 12, 16 and more. Multiple creel assemblies 10 may be arranged side-by-side (as shown in FIG. 11) and used to simultaneously run multiple ends of yarn "Y" to one or more downstream textile machines.

Stations A-D of creel assembly 10 comprise identical yarn guides, vertical side walls, and horizontal dividers. While the description below refers specifically to various elements in station-A, these exact elements are also incorporated in stations B, C, and D.

Figure 4:
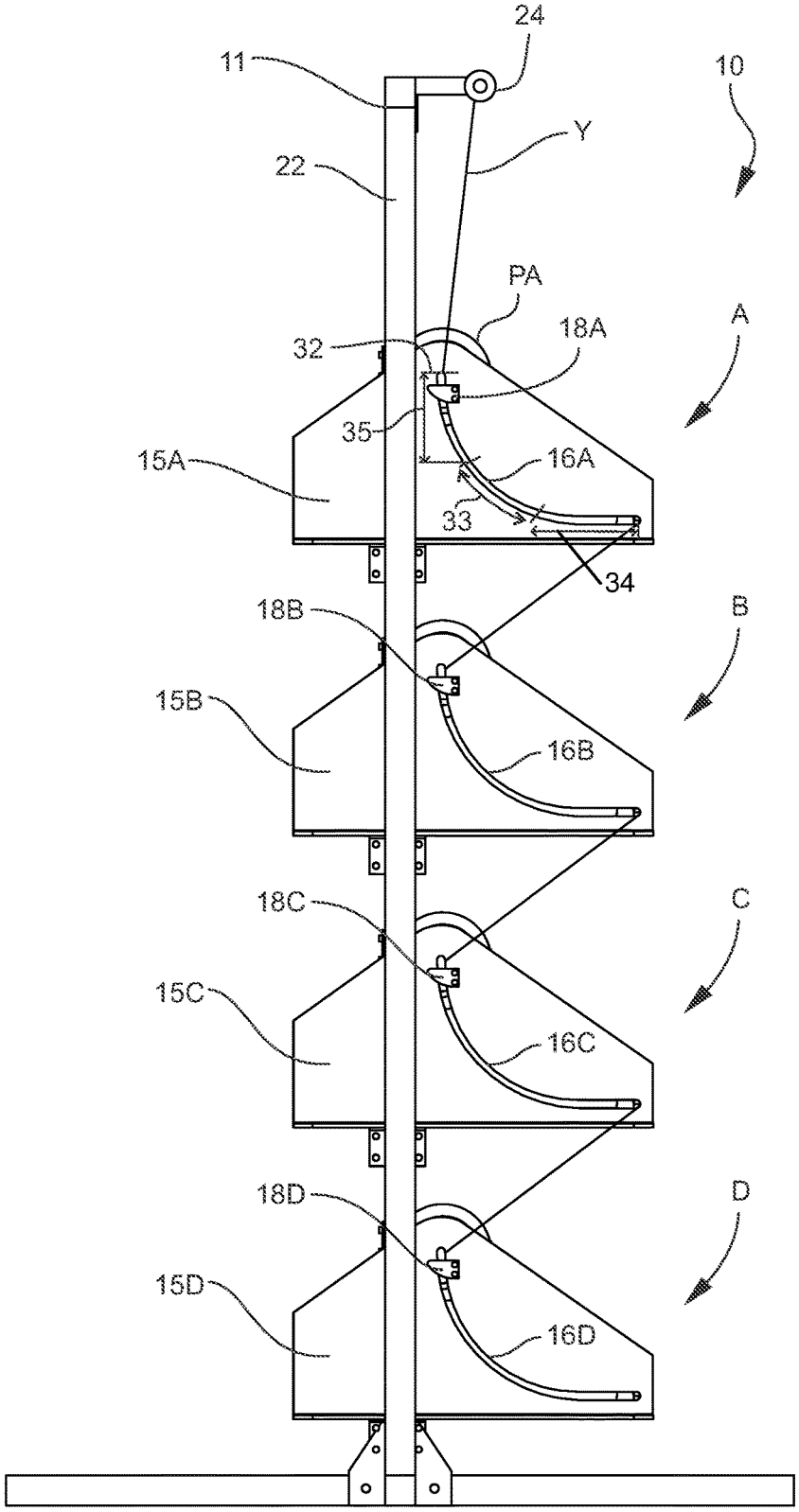
FIGS. 4-5 are respective right side and left side views of the exemplary creel assembly, and showing the yarn packages loaded and interconnected (tied together) from a top station to bottom station of the assembly.
Figure 5:
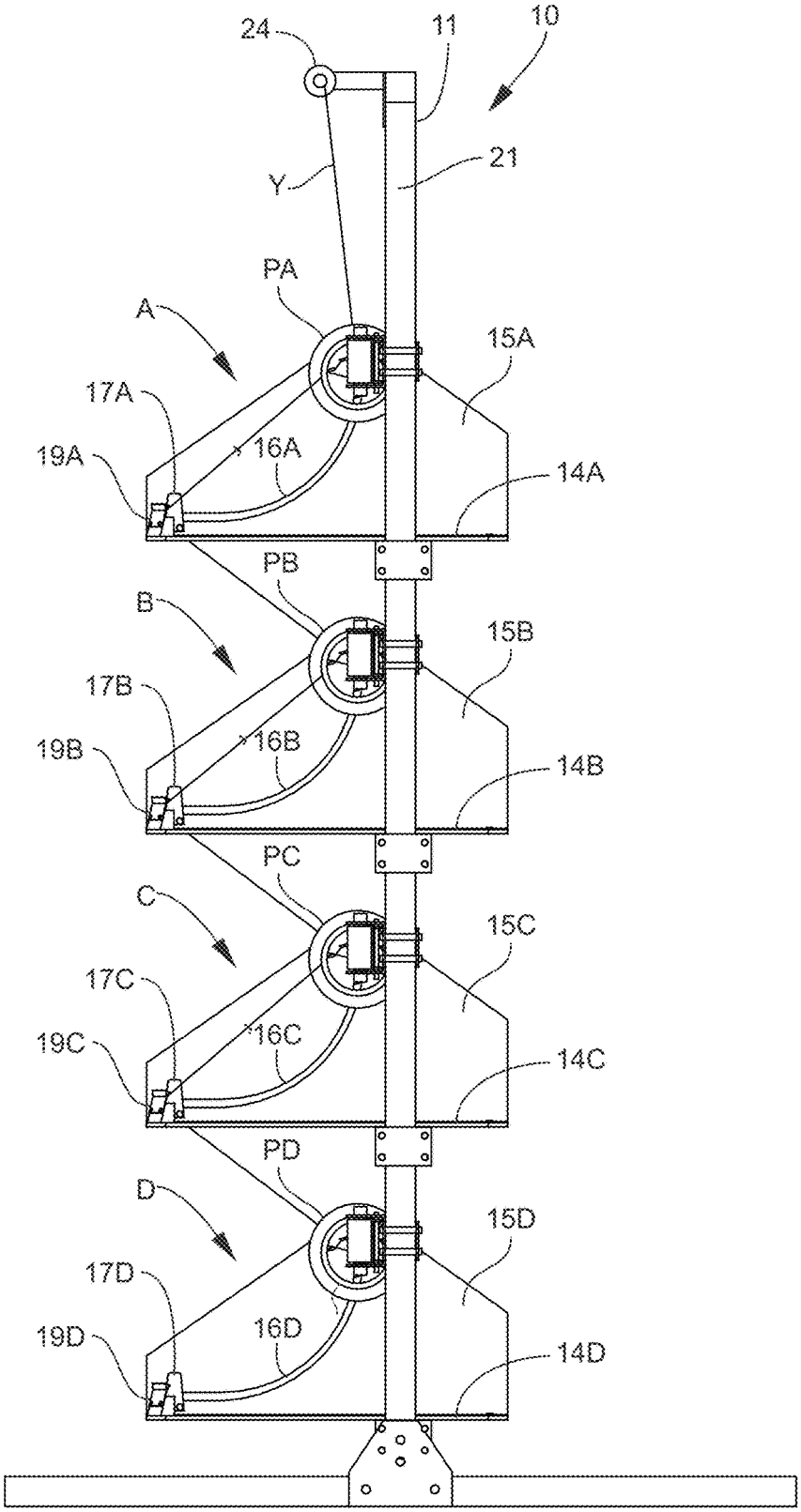
Figure 6:
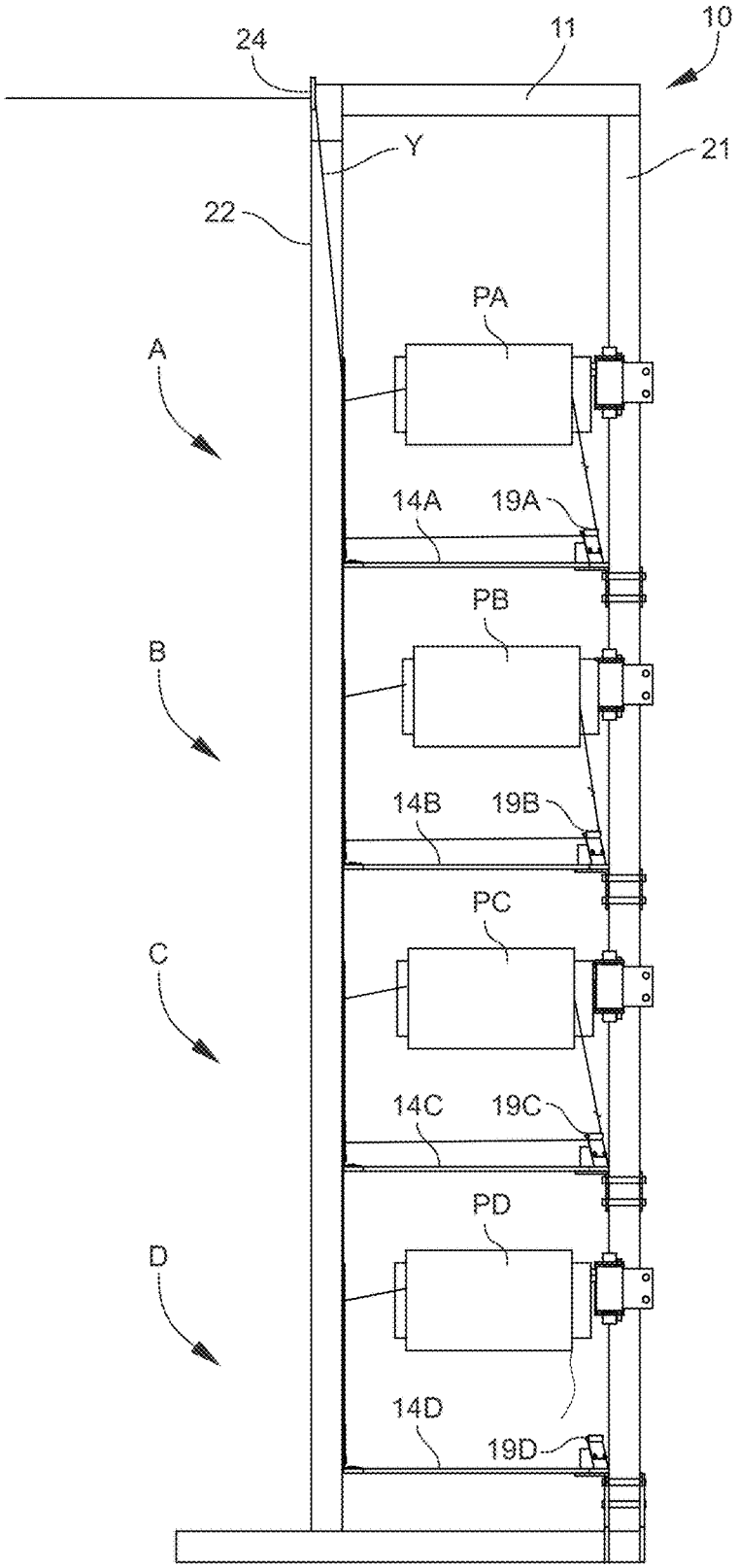
FIG. 6 is an end view of the loaded creel assembly.
Figure 9:
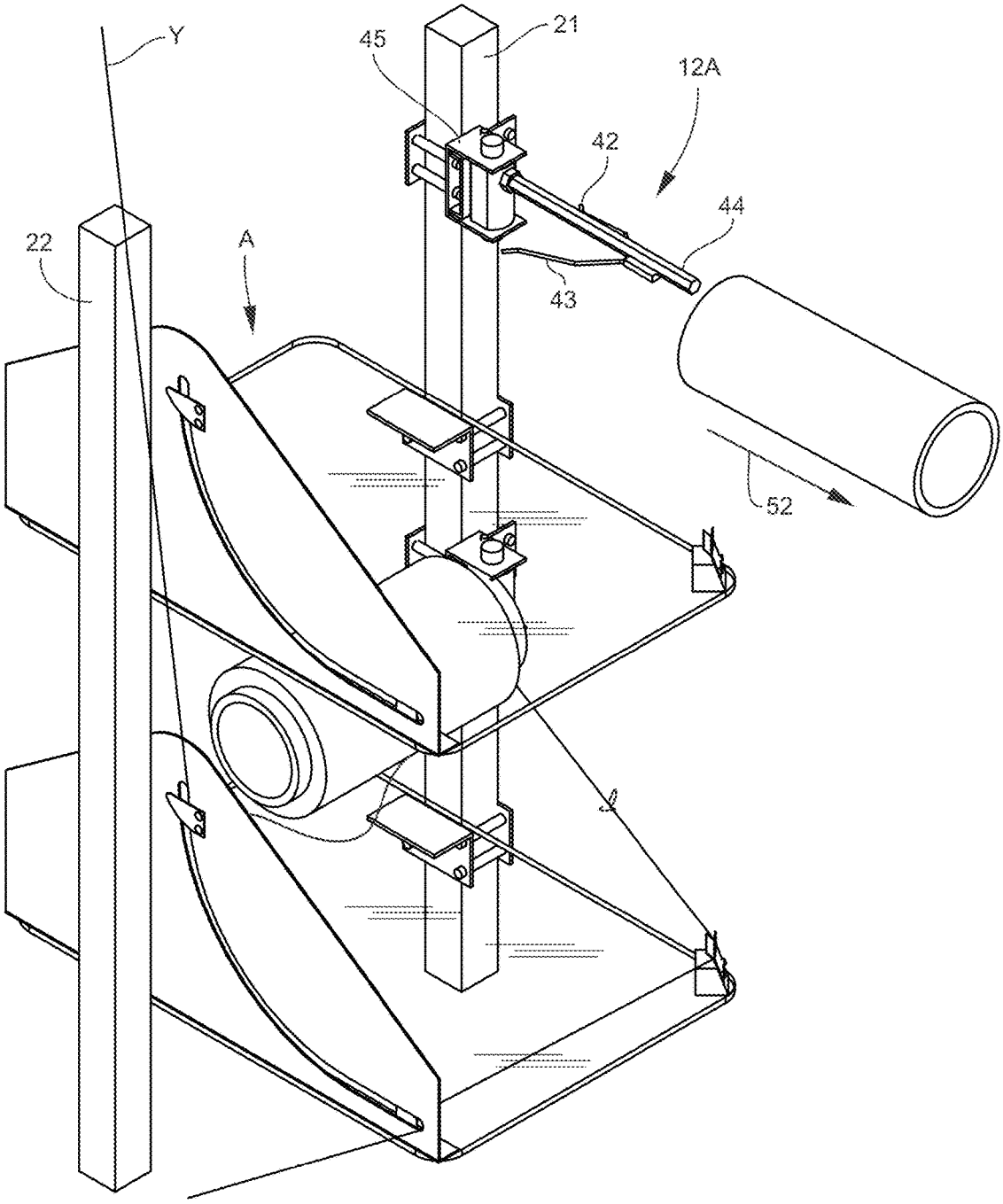

Referring to FIGS. 3A and 4, the arcuate yarn guide 16A of station-A is formed with the vertical side wall 15A and comprises a continuous curved slot having front and top end points 31 and 32, an arc portion 33, a generally horizontal portion 34, a generally vertical portion 35, and a substantially uniform width (opening) from its front to top end points 31, 32. The width is approximately 0.50 inches (in the range of 0.25 to 1.0 inches). The arc portion 33 formed between the end points 31, 32 has a curvature radius in the range of 6 to 12 inches. The generally vertical portion 35 of the arcuate guide 16A has a length of approximately 3-5 inches, while the generally horizontal portion 34 has a length of approximately 3-5 inches. The fixed-point guide 17A is located on an inside of the side wall 15A proximate the front end point 31 of the arcuate guide 16A, as best shown in FIG. 3A. The exemplary guide 17A comprises a metal finger fastened to the side wall 15A at its bottom end, and unattached to and slightly spaced from the side wall 15A at its top end such that the running yarn "Y" is free to lift and pull away from the guide 17A as the yarn transitions from one package PA to the next PB. As best shown in FIGS. 2 and 4, fixed-point guide 18A is located on an outside of the side wall 15A proximate the top end point 32 of the arcuate yarn guide 16A. Exemplary guide 18A comprises a metal finger fastened to the side wall 15A at its forward end, and unattached to and slightly spaced from the side wall 15A at its rearward end—thereby allowing the running yarn "Y" to pull away from the guide 15A as the yarn transitions from one package PA to the next PB. The third fixed-point yarn guide 19A is mounted on the horizontal station divider 14A, and located forward of and below the package holder 12A (FIGS. 9 and 10). This exemplary guide 19A comprises a pair of closely-spaced metal fingers having respective outwardly angled ends designed to readily receive the yarn "Y", and cooperating to temporarily hold the yarn in a transition-ready state prior to emptying the currently running yarn package PA. An alternative divider-mounted guide (not shown) may comprise a spring-loaded clip or the like. As shown in FIG. 1 (and represented for illustration purposes in station-D), guide 19D is generally aligned as indicated at broken line 38 with the tail end of yarn package PD at the proximal end of package holder, and in substantial linear alignment with the front end point 31 and fixed-point guide 17D, as indicated at broken line 39. Exemplary guides in stations A-C are arranged in an identical manner. Transition of the running yarn "Y" from one package to the next is described further below with reference to FIGS. 12-22.

Figure 7:
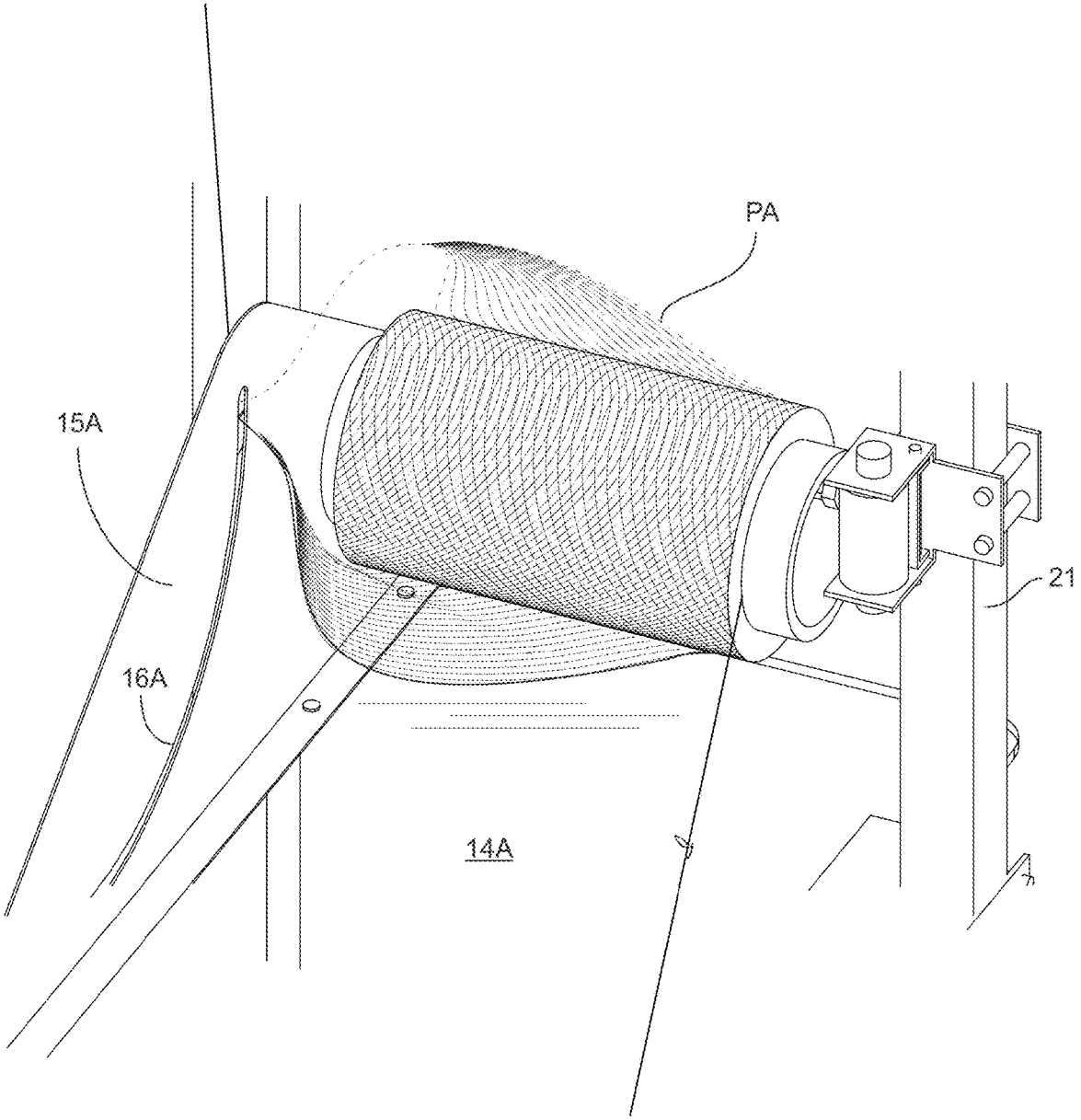
FIG. 7 is a fragmentary view illustrating the ballooning of yarn pulled from a running package.

FIGS. 1-6 illustrate a multiple-station creel assembly 10 formed in a single column comprising vertically aligned package stations A-D and respective interconnected yarn packages PA, PB, PC, and PD. A single end of yarn "Y" passes through the frame-mounted guide eye 24, and is drawn off each of the yarn packages PA, PB, PC, PD to provide an uninterrupted yarn supply from one station to the next. In one implementation, the yarn packages PA, PB, PC, PD are joined together in series by feeding the head end of yarn package PB in station-B through the arcuate guide 16B and fixed-point guide 18B, through the arcuate guide 16A and fixed point guide 17A in station-A, and through the divider-mounted guide 19A in station-A. The head end of package PB is then tied to the tail end of package PA in station-A. Yarn package PC is tied to yarn package PB and yarn package PD tied to yarn package PC in an identical manner. As discussed below, once the packages PA, PB, PC, PD are interconnected (tied together), yarn drawn off an emptying first package PA in station-A transitions to a full package PB in station-B. The emptying yarn package PB transitions to the full package PC, and the emptying package PC transitions to the full package PD. In this manner, a single uninterrupted end of yarn "Y" is drawn off 4 interconnected yarn packages PA-PD without any required intervening replacement of emptied packages ("bobbins" or "carriers") in the creel assembly 10, and without interrupting downstream operation of the textile machine. FIG. 7 illustrates the ballooning of yarn package PA adjacent the horizontal station divider 14A and vertical side wall 15A in station-A in a manner which may reduce tension variation (as compared to conventional creels) as the yarn is drawn off package PA.

Figure 8:
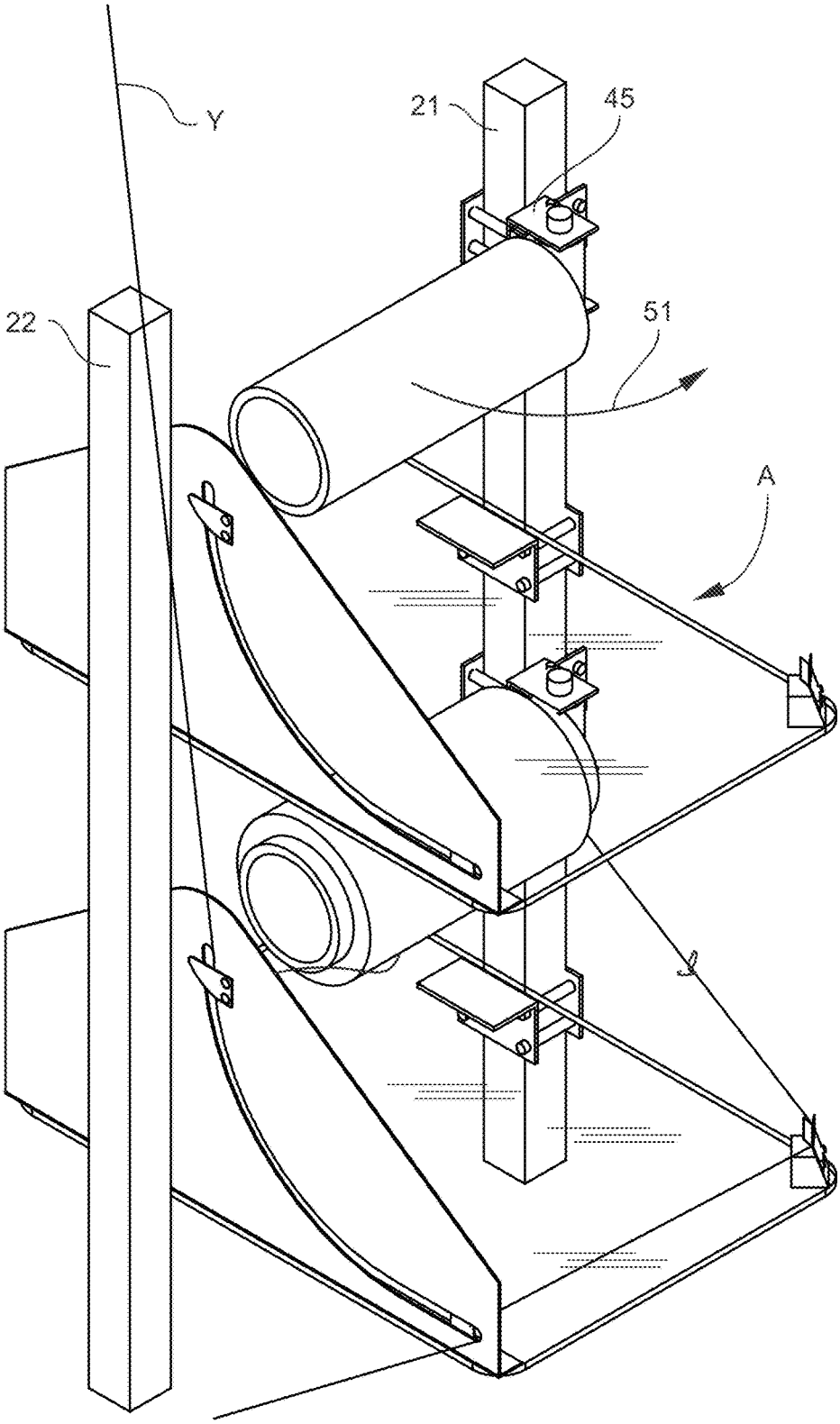
FIGS. 8, 9, and 10 are sequential views demonstrating replacement of an emptied yarn package in an upper station of the creel assembly.

FIGS. 8-10 demonstrate one exemplary process for replacing an emptied yarn package PA carried on package holder 12A (See FIGS. 9 and 10) in station-A; the process being equally applicable for replacing emptied packages PB-PD in stations B-D. The exemplary package holder 12A comprises an elongated rigid mounting shaft 41 and cooperating resilient metal arms 42, 43. The package holder 12A is pivotably attached to frame member 21 at pivot bracket 45, and is designed for manual movement between a 0-degree package ready position and a substantially 90-degree package replacement position. The package holder 12A with emptied yarn carrier is pivoted, as indicated at arrow 51, from the package ready position shown in FIG. 8 to the package replacement position shown in FIGS. 9 and 10. In the replacement position, the emptied yarn carrier is removed from the package holder 12A, as indicated at arrow 52, and the carrier replaced with a full package PA by sliding the full package PA onto the mounting shaft 41, as indicated by arrow 53 in FIG. 10. Resilient arms 42, 43 of the package holder 12A flex inwardly and frictionally engage the cylindrical inside wall of the yarn package PA to temporarily hold and secure the package.

Figure 12:
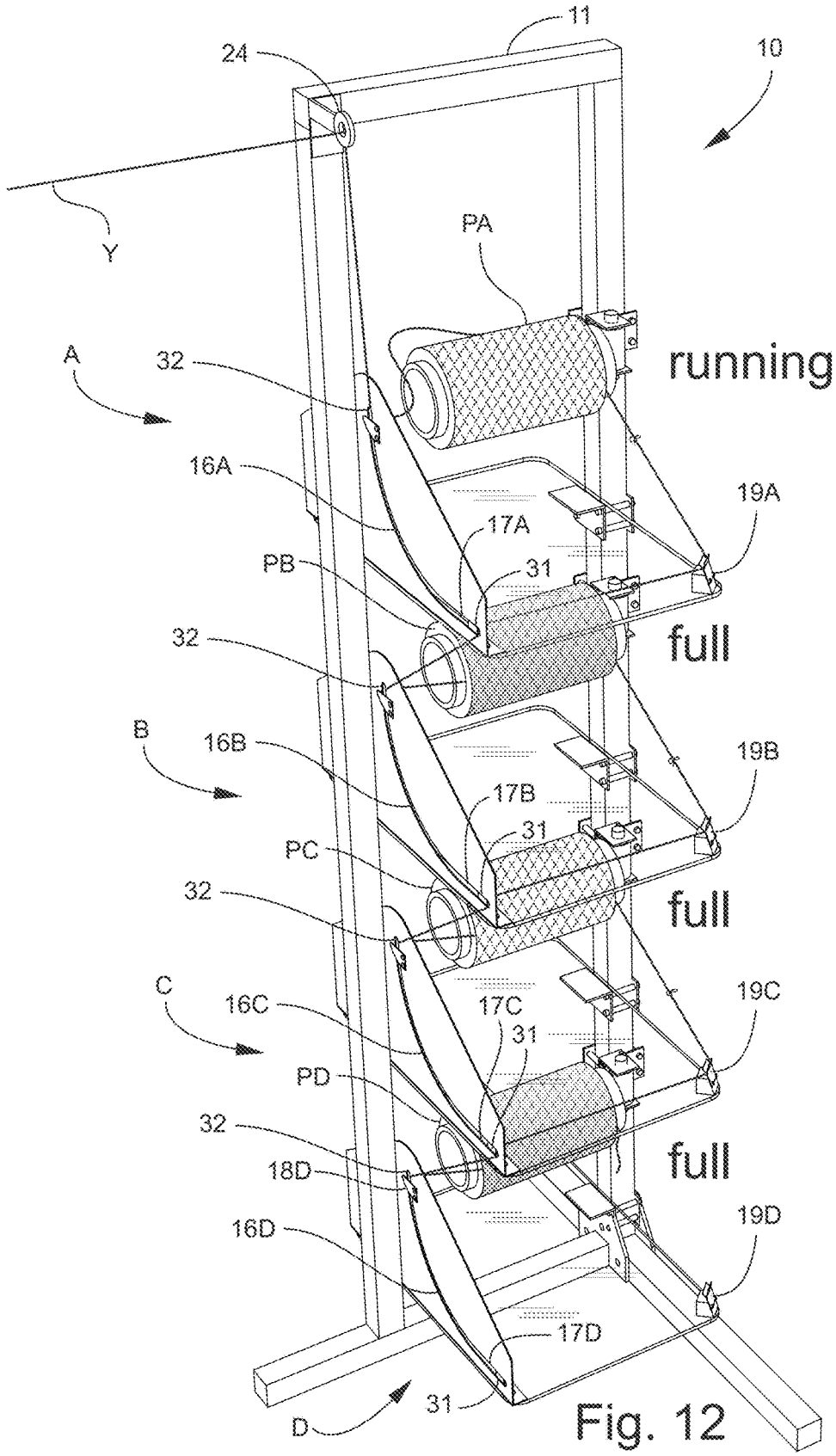
FIGS. 12-22 are sequential views demonstrating operation of the exemplary yarn creel assembly.
Figure 13:
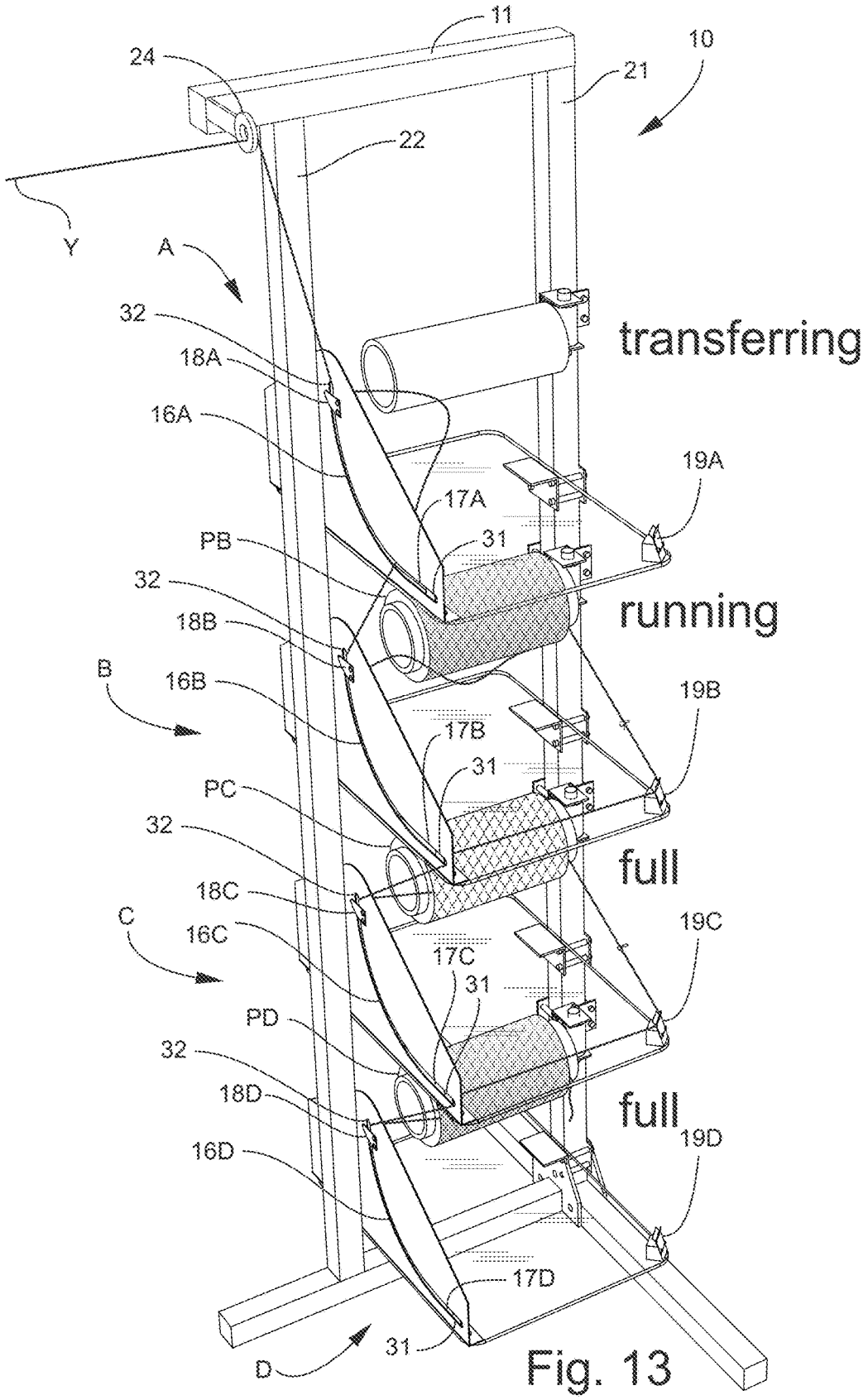
Figure 14:
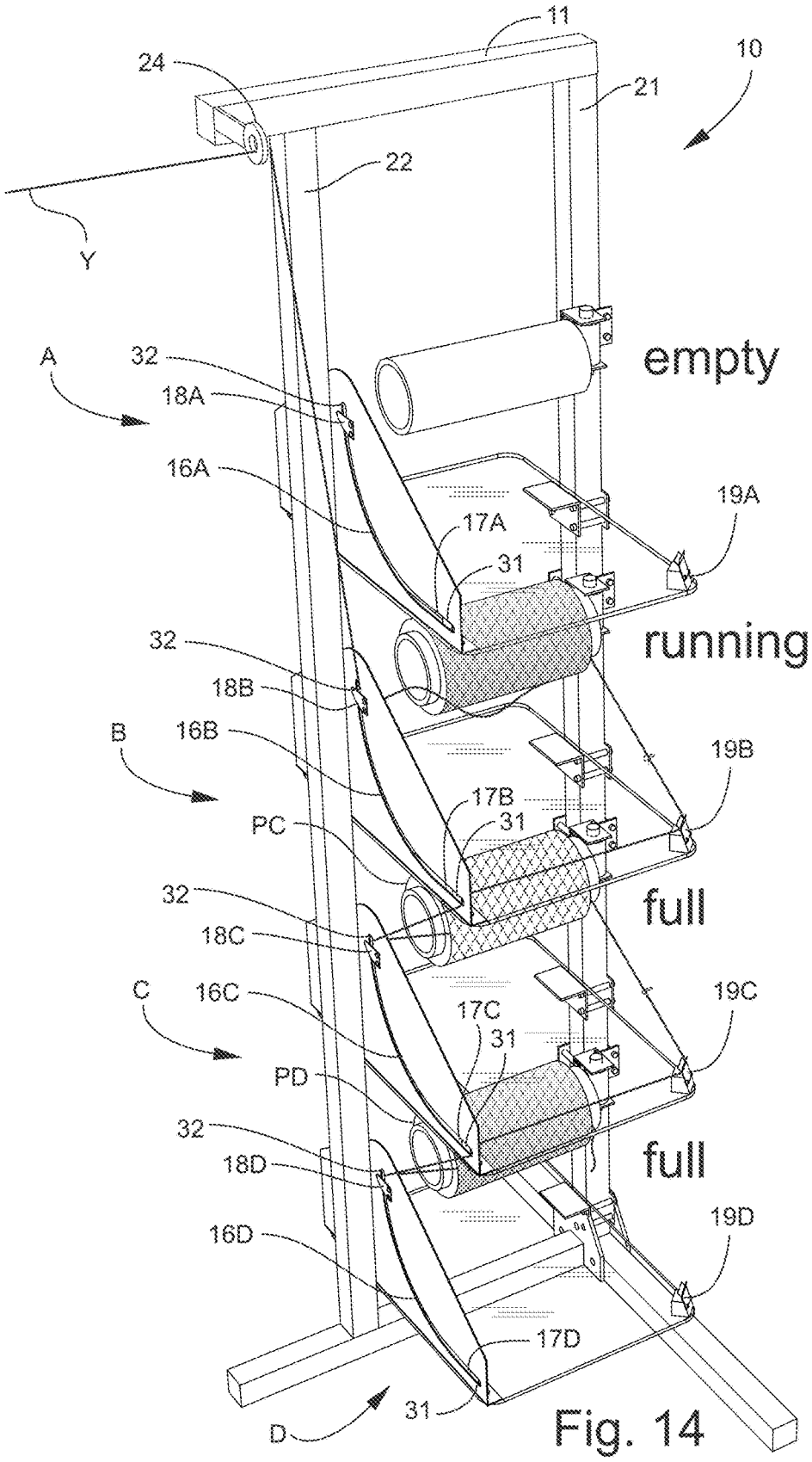
Figure 15:
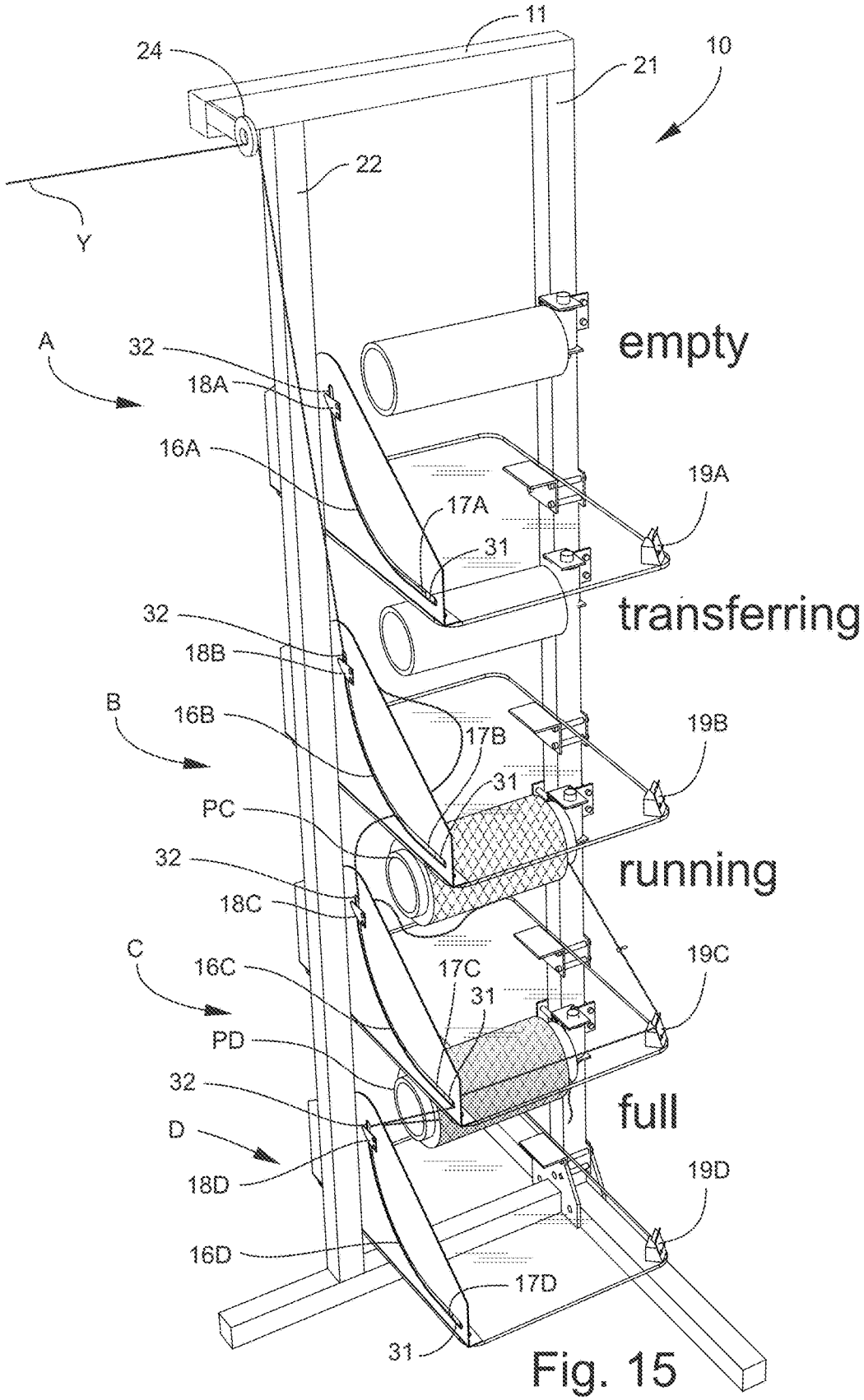
Figure 16:
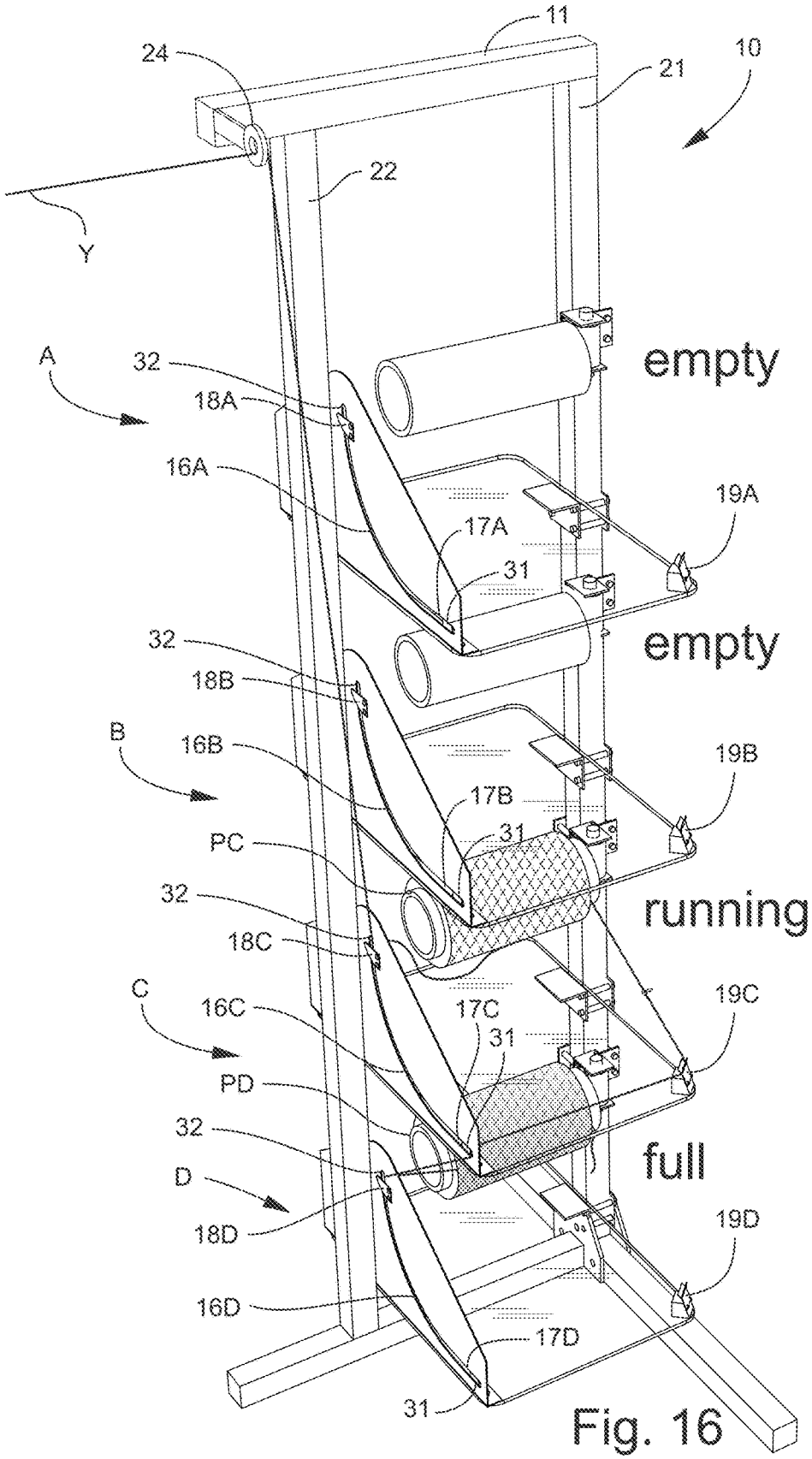
Figure 17:
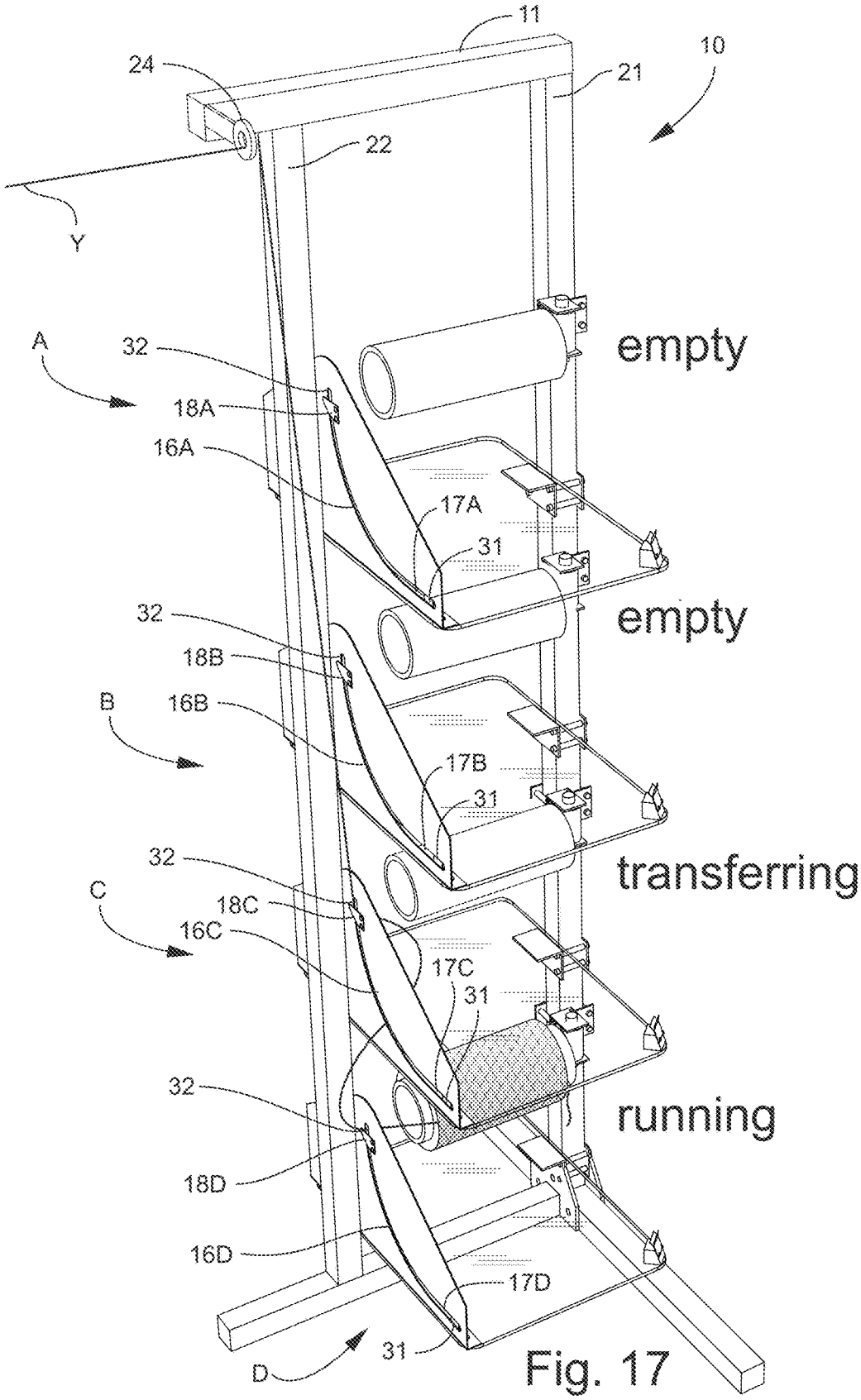
Figure 18:
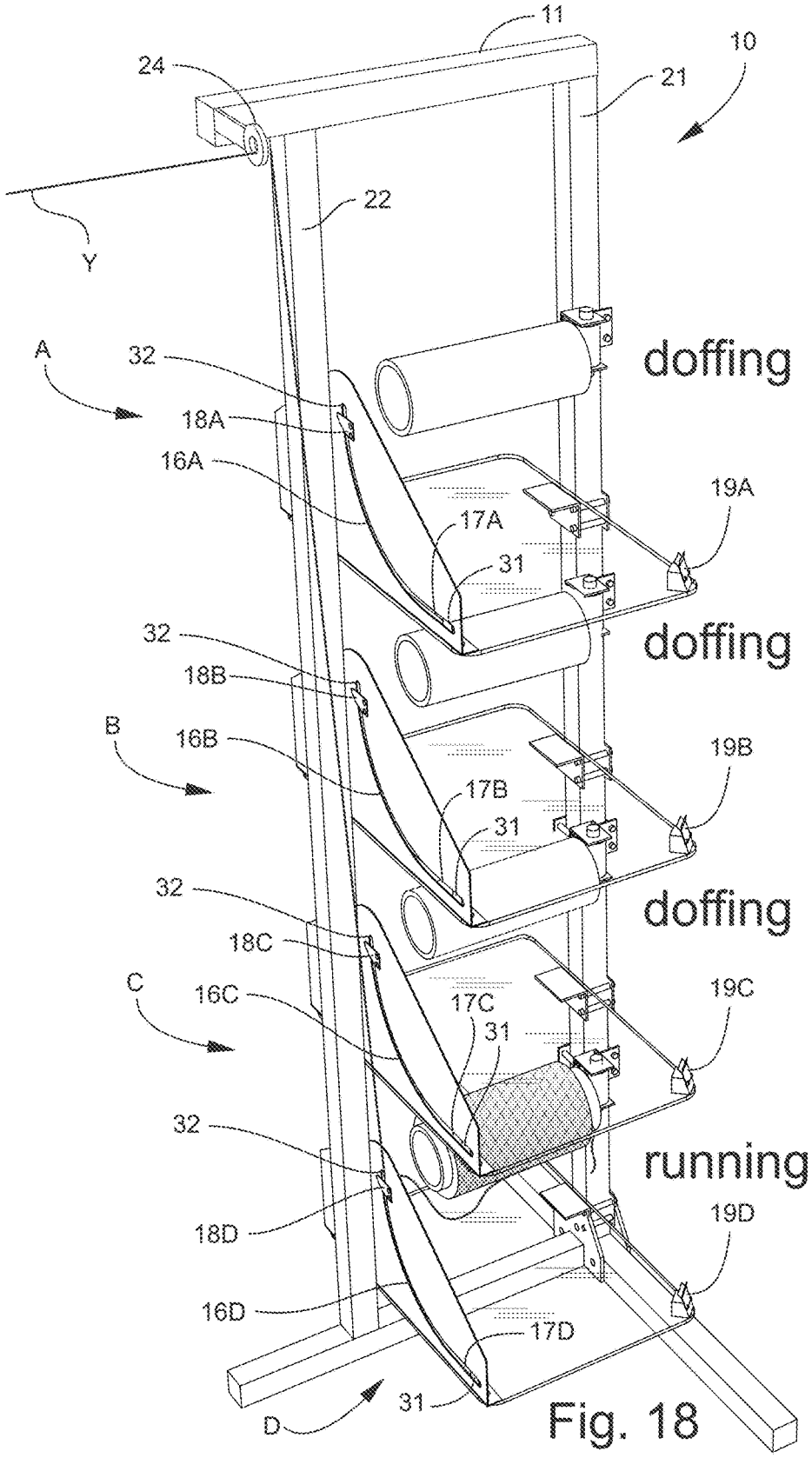
Figure 19:
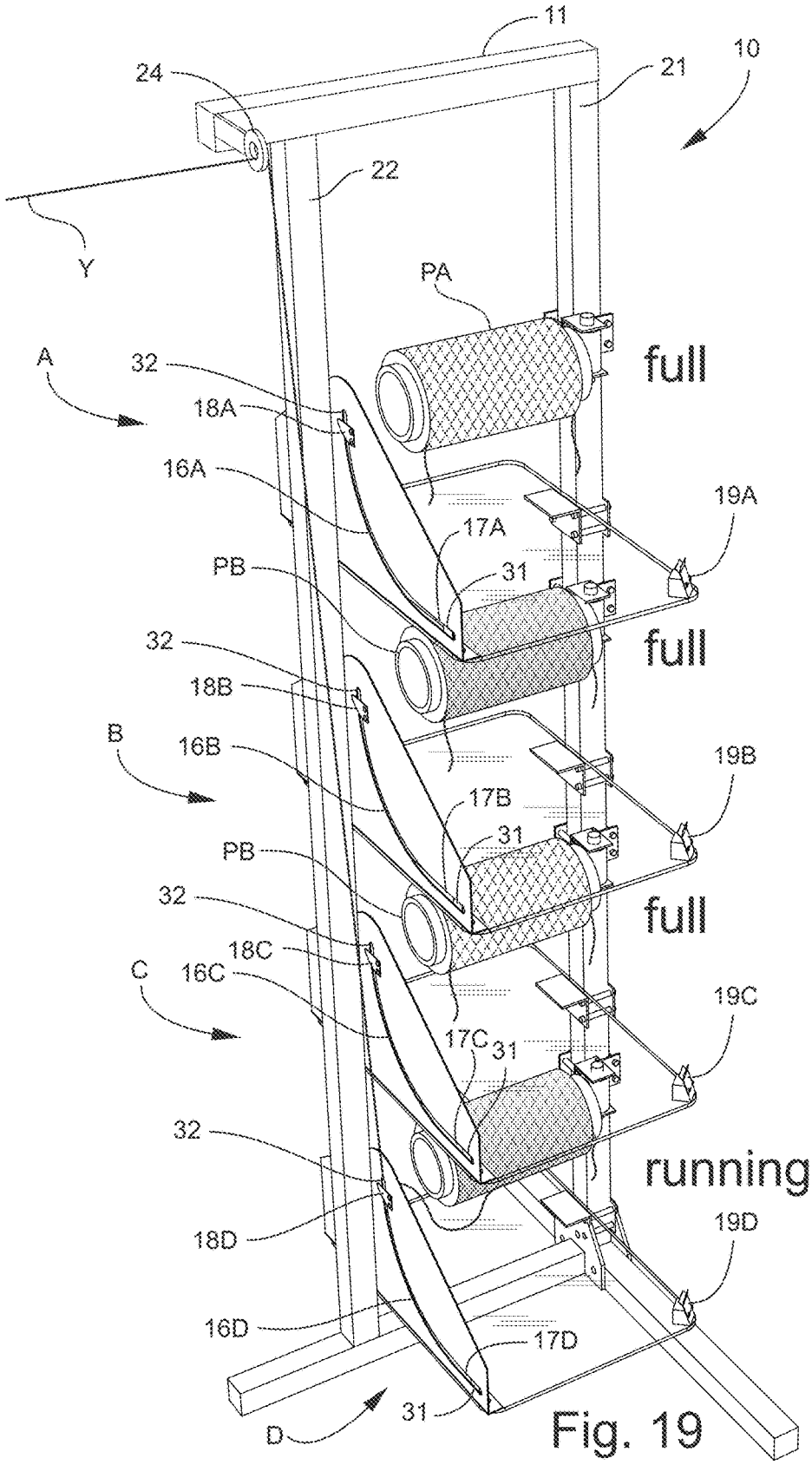

FIGS. 12-22 are sequential views demonstrating an exemplary utility of the present yarn creel assembly 10, and the loading and replacement of yarn packages PA, PB, PC, PD within each station A-D. From the running package PA, the yarn end "Y" passes through guide eye 24 attached to mounting frame 11 to a downstream textile machine (not shown). As shown in FIG. 12, all stations A-D of the exemplary creel assembly 10 are pre-loaded with respective yarn packages PA, PB, PC, and PD, and the packages tied together tail-to-head as previously described. Once package PA is emptied, as shown in FIG. 13, the running yarn "Y" transitions from station-A to station-B by first pulling away from fixed-point guides 19A and 17A (FIG. 1), and then sliding along a curved path defined by arcuate guide 16A from its front end point 31 towards its top end point 32. At the top end point 32 of arcuate guide 16A, the running yarn "Y" pulls away from the fixed-point guide 18A in station-A, thereby completing its transition to station-B. The uninterrupted running yarn "Y" is then drawn from package PB, as shown in FIG. 14. After package PB is emptied, as shown in FIG. 15, the running yarn "Y" transitions from station-B to station-C by pulling away from fixed-point guides 19B and 17B (FIG. 1), and then sliding along the curved path defined by arcuate guide 16B from its front end point 31 towards its top end point 32. At the top end point 32 of arcuate guide 16B, the running yarn "Y" pulls away from the fixed-point guide 18B in station-B, thereby completing its transition to station-C. The uninterrupted running yarn "Y" is then drawn from package PC, as shown in FIG. 16. After package PC is emptied, as shown in FIG. 17, the running yarn "Y" transitions from station-C to station-D by pulling away from fixed-point guides 19C and 17C (FIG. 1), and then sliding along the curved path defined by arcuate guide 16C from its front end point 31 towards its top end point 32. At the top end point 32 of arcuate guide 16C, the running yarn "Y" pulls away from the fixed-point guide 18C in station-C, thereby completing its transition to station-D. The uninterrupted running yarn "Y" is then drawn from package PD, as shown in FIG. 18. At this point, all emptied yarn carriers in stations A, B, and C are replaced with full packages PA, PB, and PC, as illustrated in FIG. 19, in the manner described above.

Figure 20:
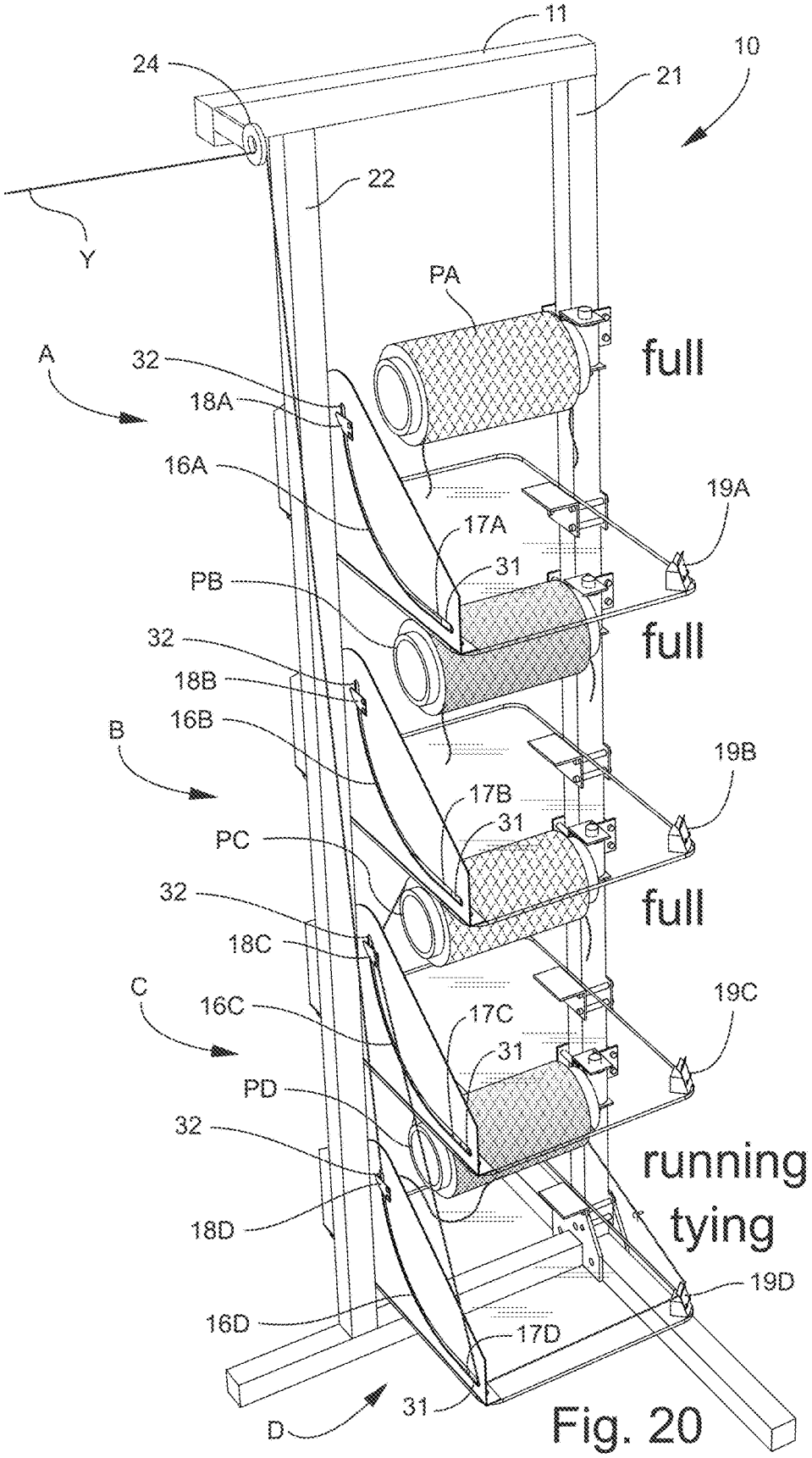
Figure 21:
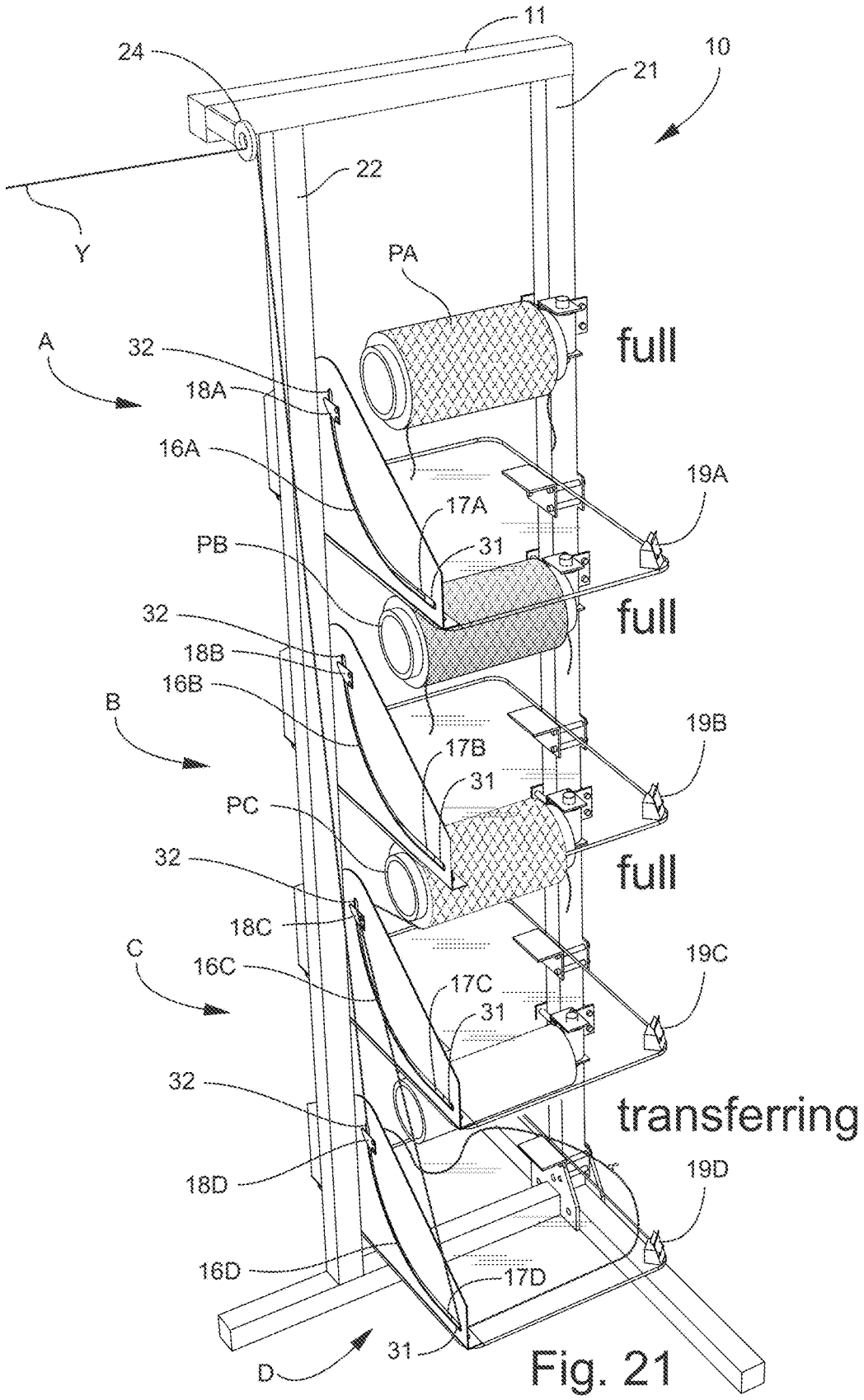
Figure 22:
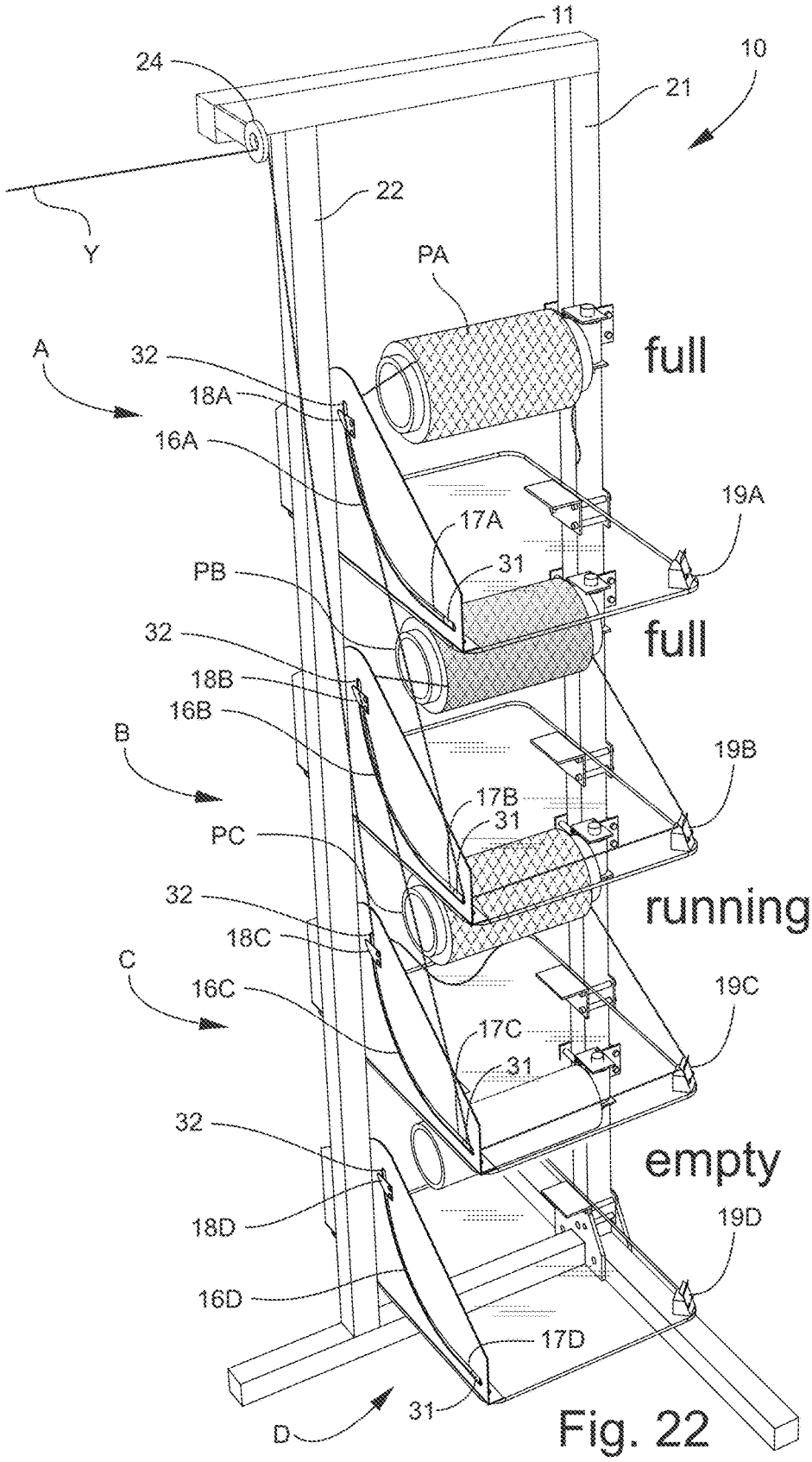

After replenishing stations A, B, and C with full yarn packages PA, PB, PC, the head end of package PC is passed through arcuate guide 16C and fixed-point guide 17C (FIG. 1) in station-C, downwardly through arcuate guide 16D and fixed-point guide 17D (FIG. 1) in station-D, and through the divider-mounted guide 19D in station-D. The head end is then tied to the tail end of running package PD, as indicated in FIG. 20. After package PD is emptied, as shown in FIG. 21, the running yarn "Y" transitions from station-D up to station-C by pulling away from fixed-point guides 19D and 17D (FIG. 1), and then sliding along the curved path defined by arcuate guide 16D from its front end point 31 towards its top end point 32. At the top end point 32 of arcuate guide 16D, the running yarn pulls away from the fixed-point guide 18D in station-D, thereby completing its transition to station-C. The uninterrupted running yarn "Y" is then drawn from package PC, as shown in FIG. 22. The exact process continues upwardly to stations B and A. While drawing yarn from top station-A, the emptied yarn carriers in stations B, C, and D are replaced with full yarn packages PB, PC, PD which are tied together tail-to-head as previously described. While the exemplary process described above draws yarn from packages PA to PD in stations A-D, and then upwardly from packages PD to PA, it is understood that the various packages PA-PD may be interconnected (or tied together) in any desired order from one station to the next. For example, package PD may be tied directly to package PA in station-A, such that the running yarn transitions from station-D to station-A; and package PA tied to package PB, and so forth.

Figure 23:
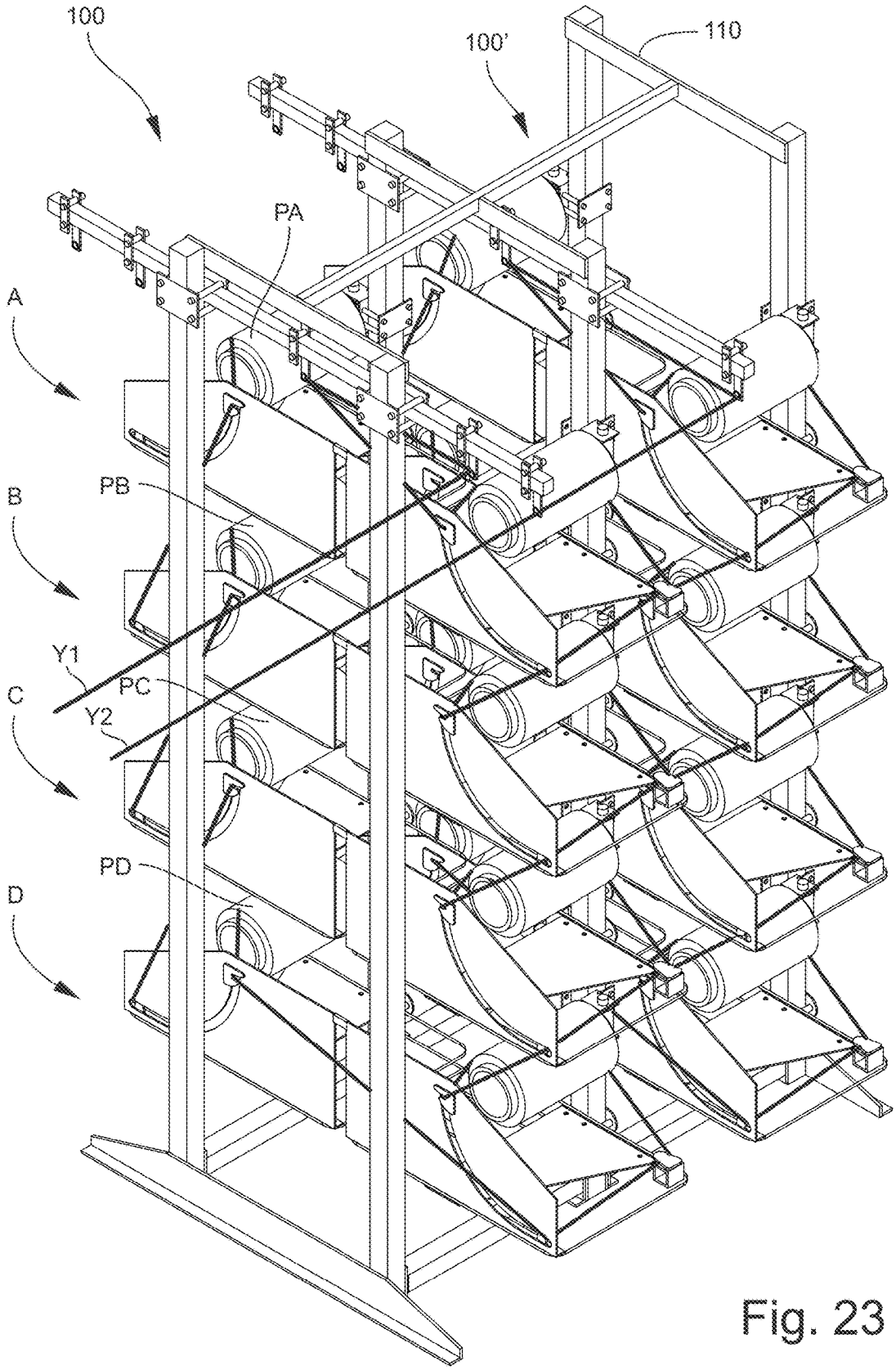
FIGS. 23-30 illustrate further exemplary embodiments of the present creel assembly.
Figure 24:
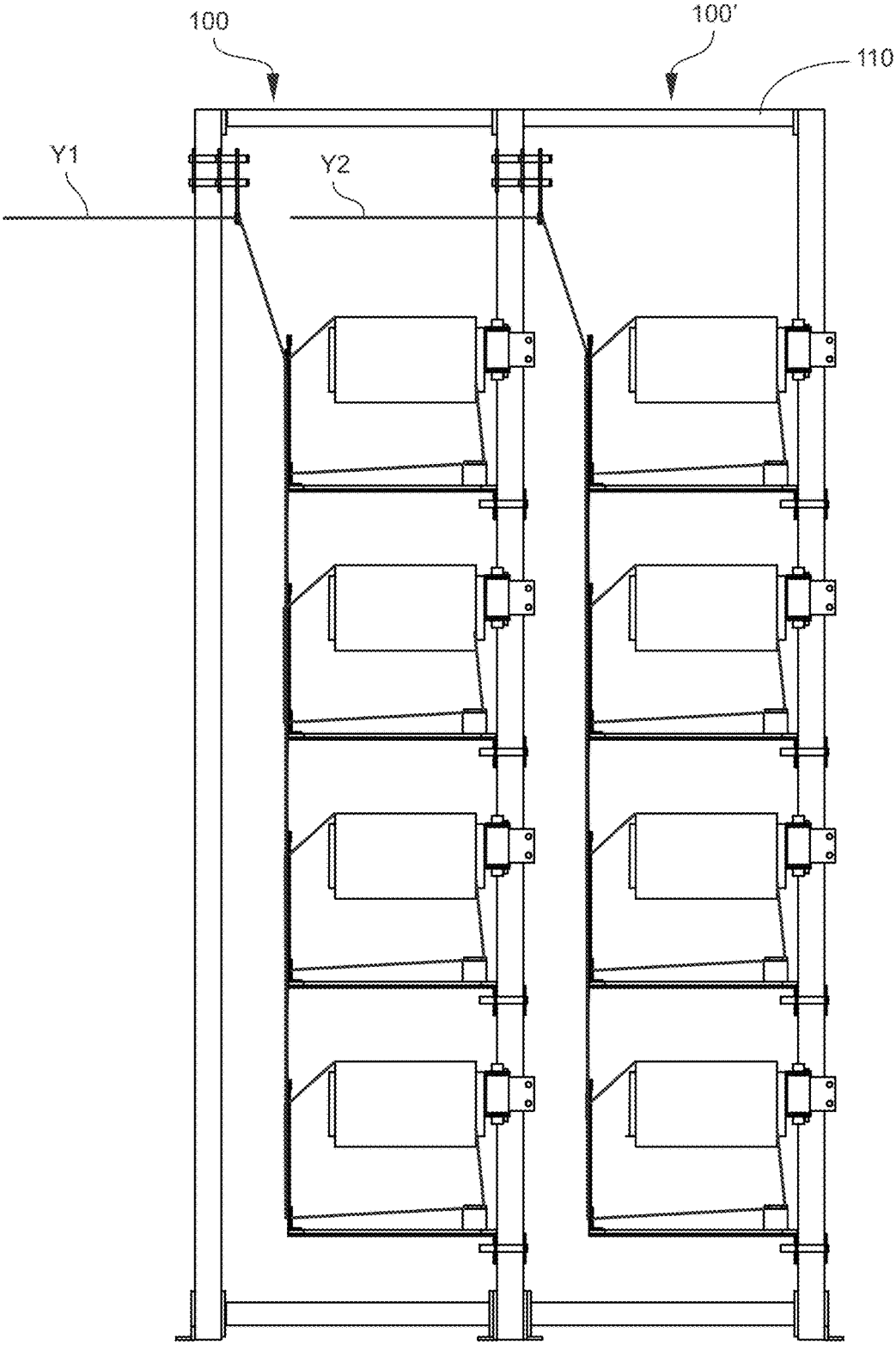
Figure 25:
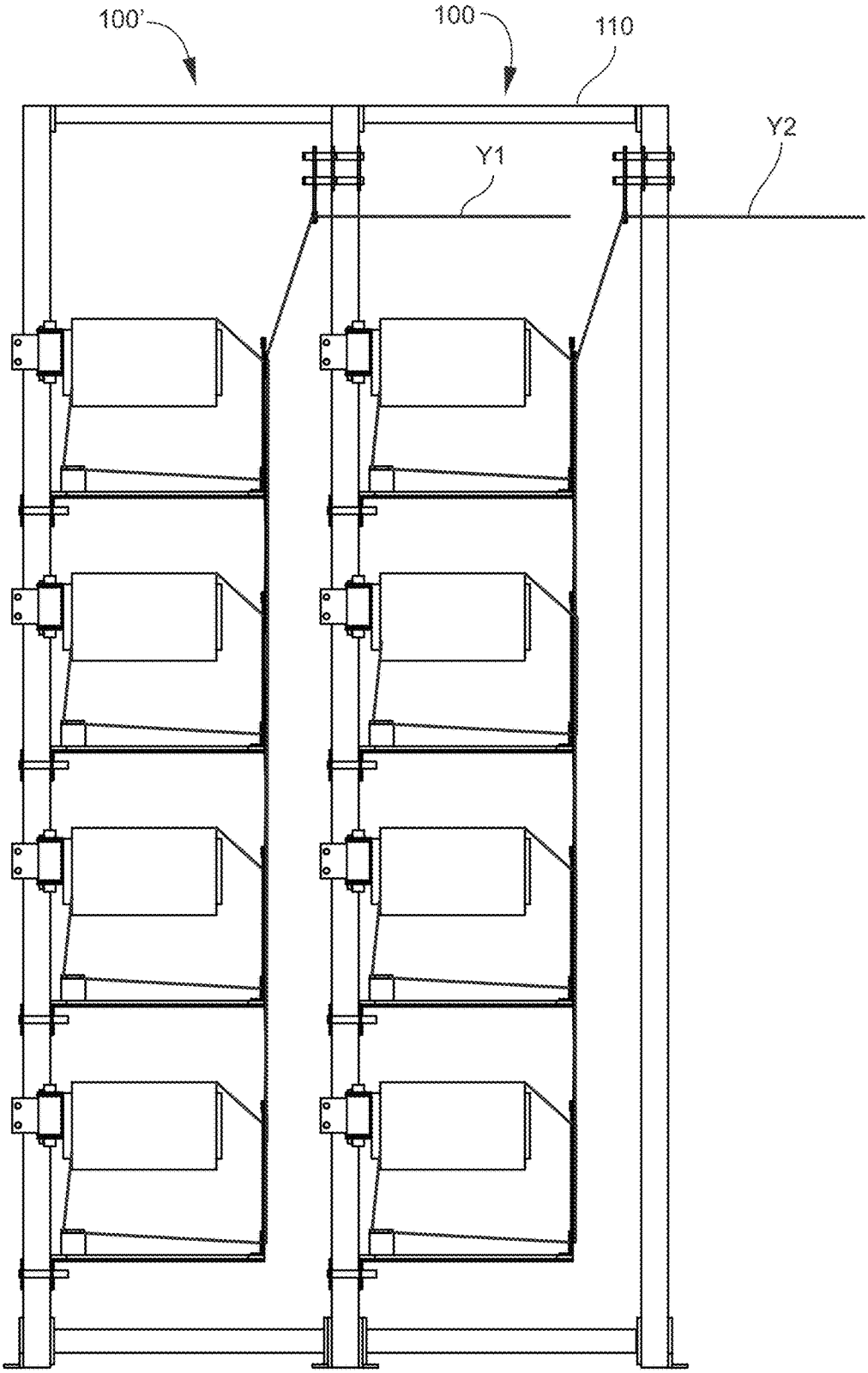
Figure 26:
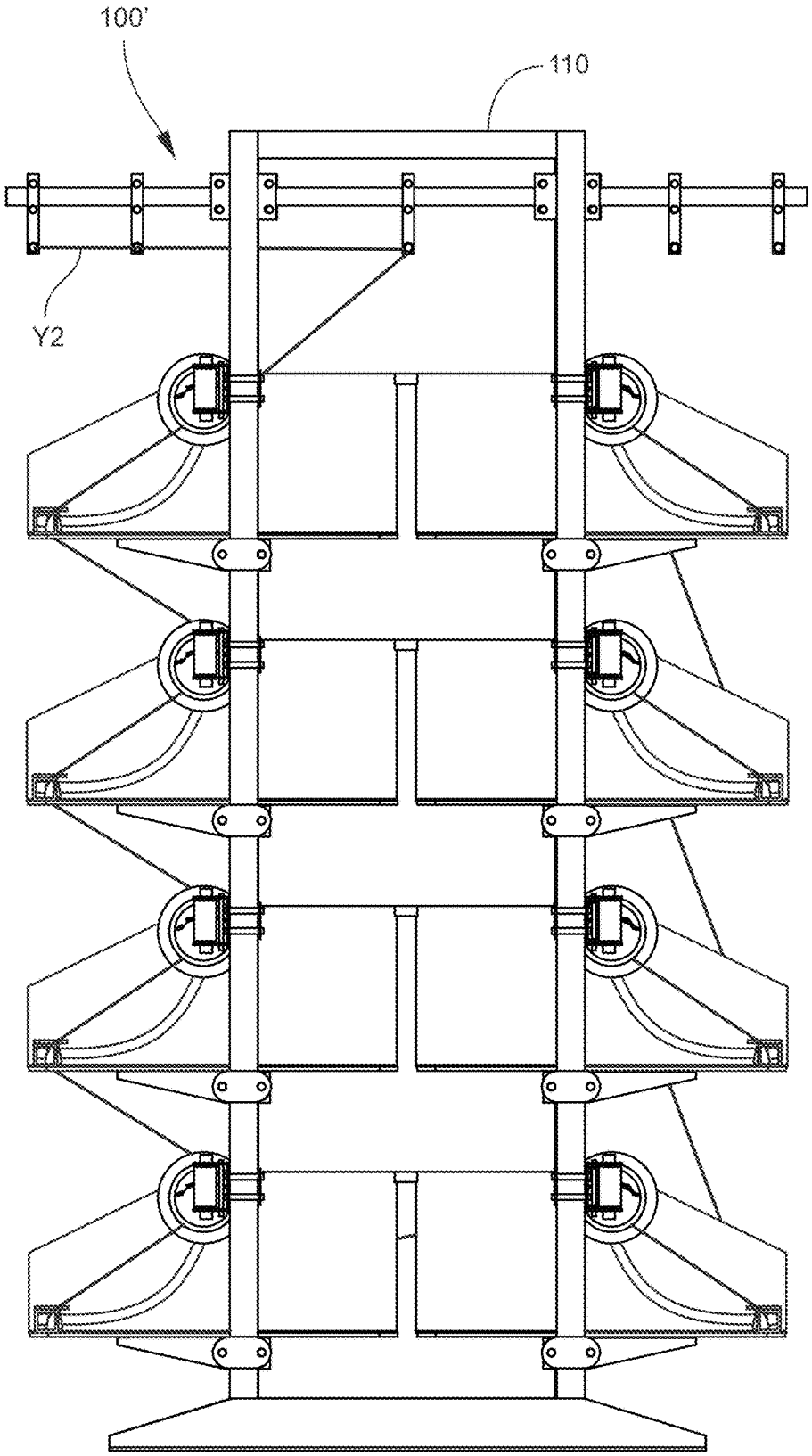
Figure 27:
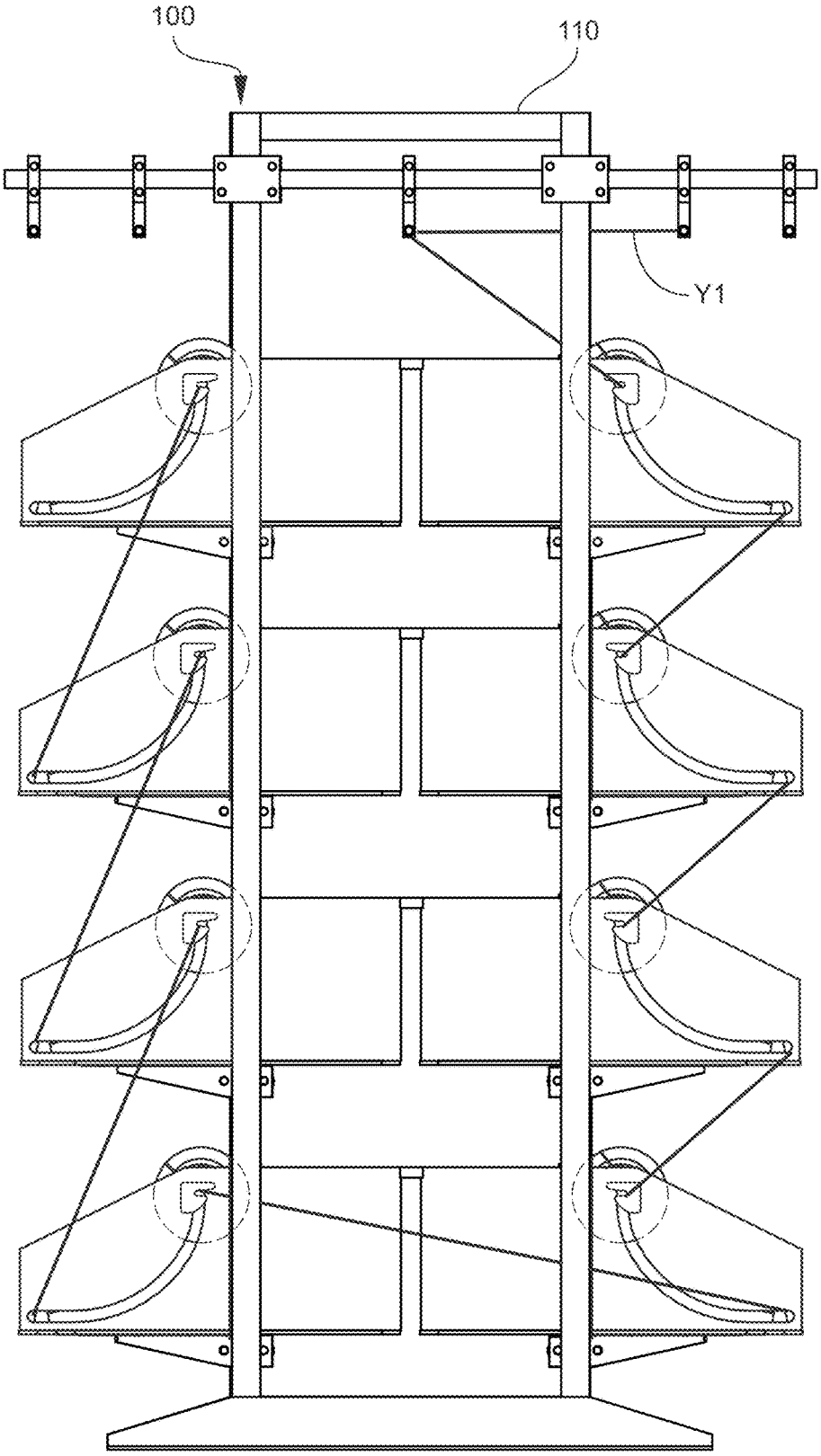
Figure 28:
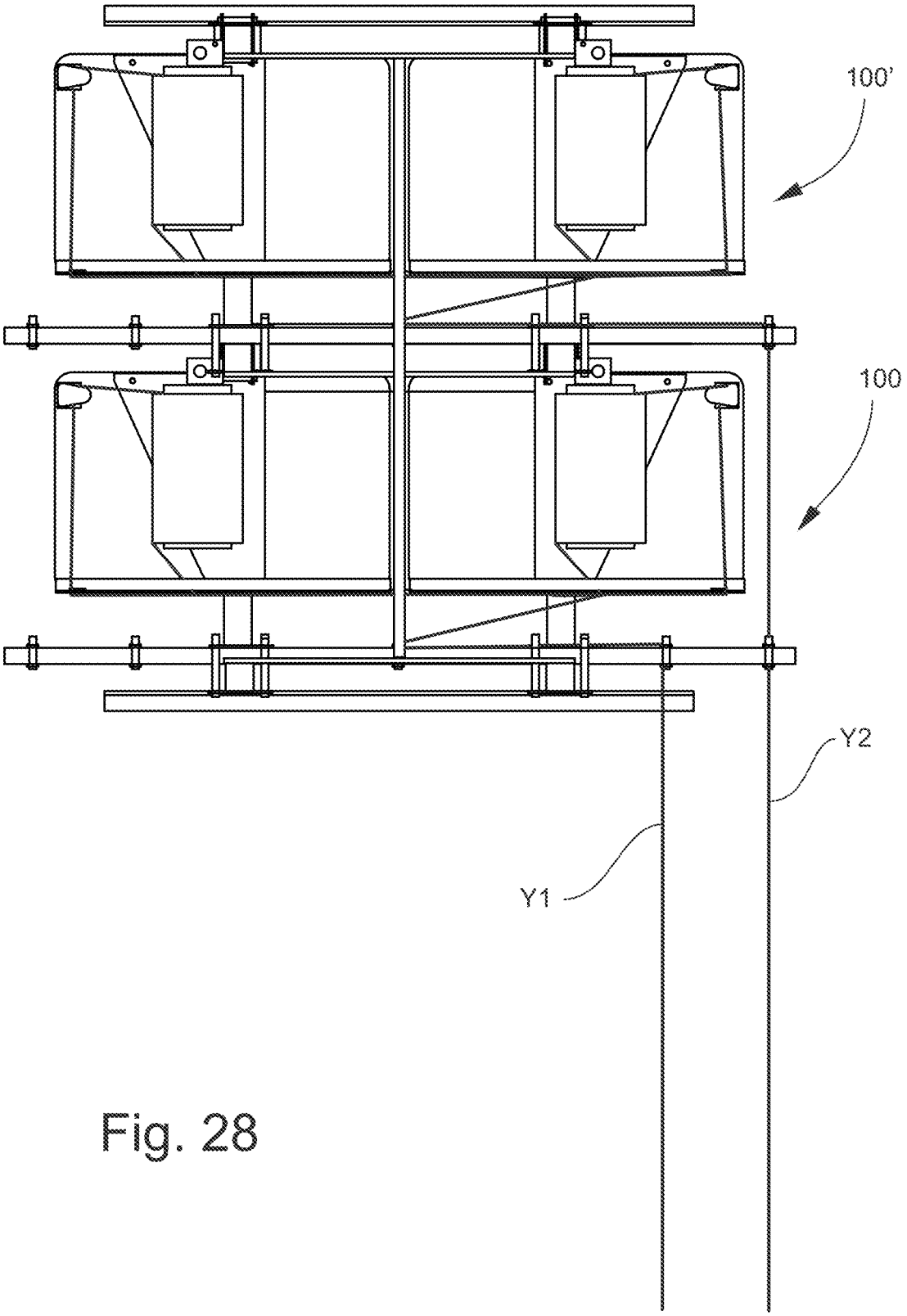
Figure 29:
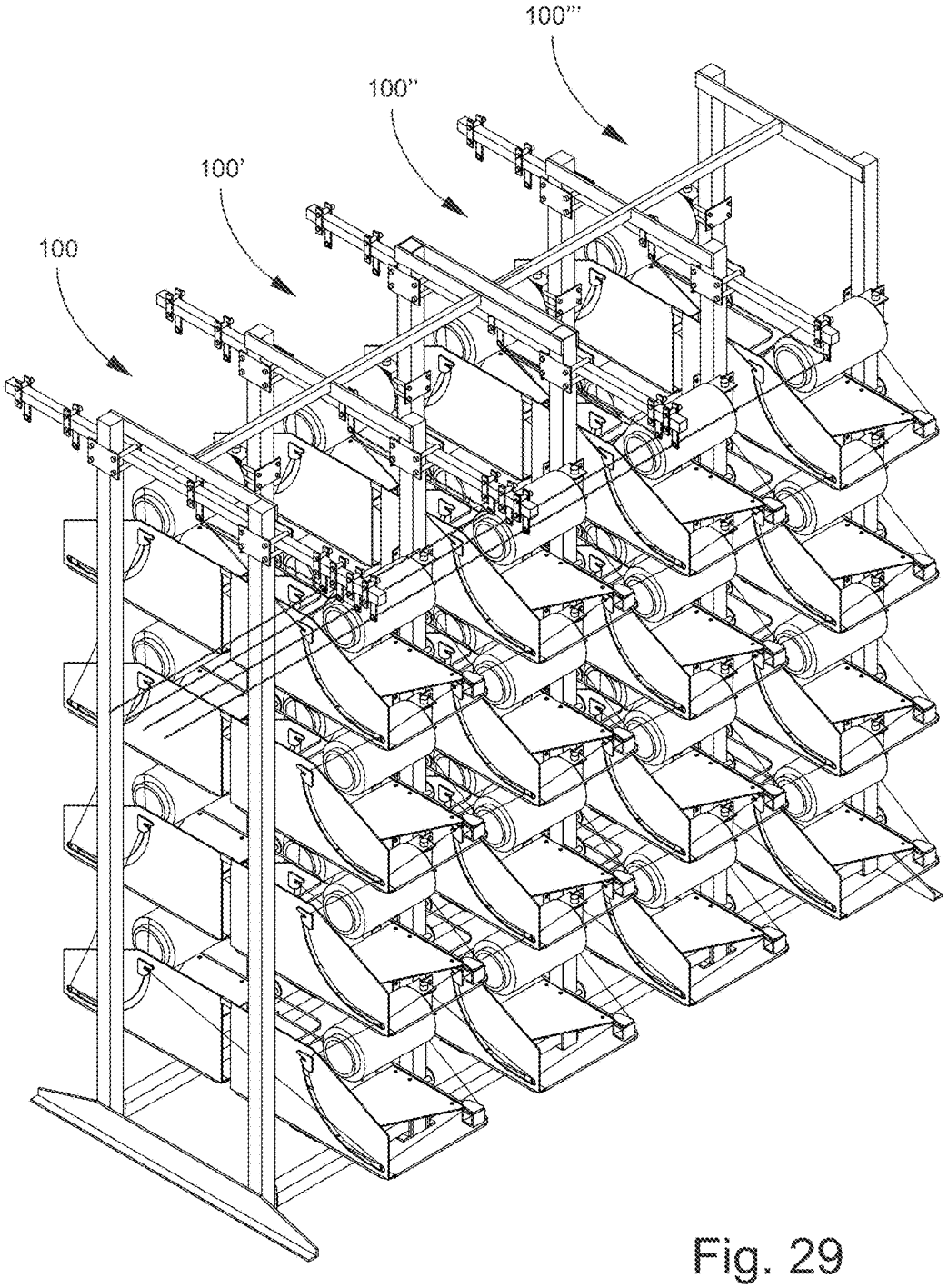
Figure 30:
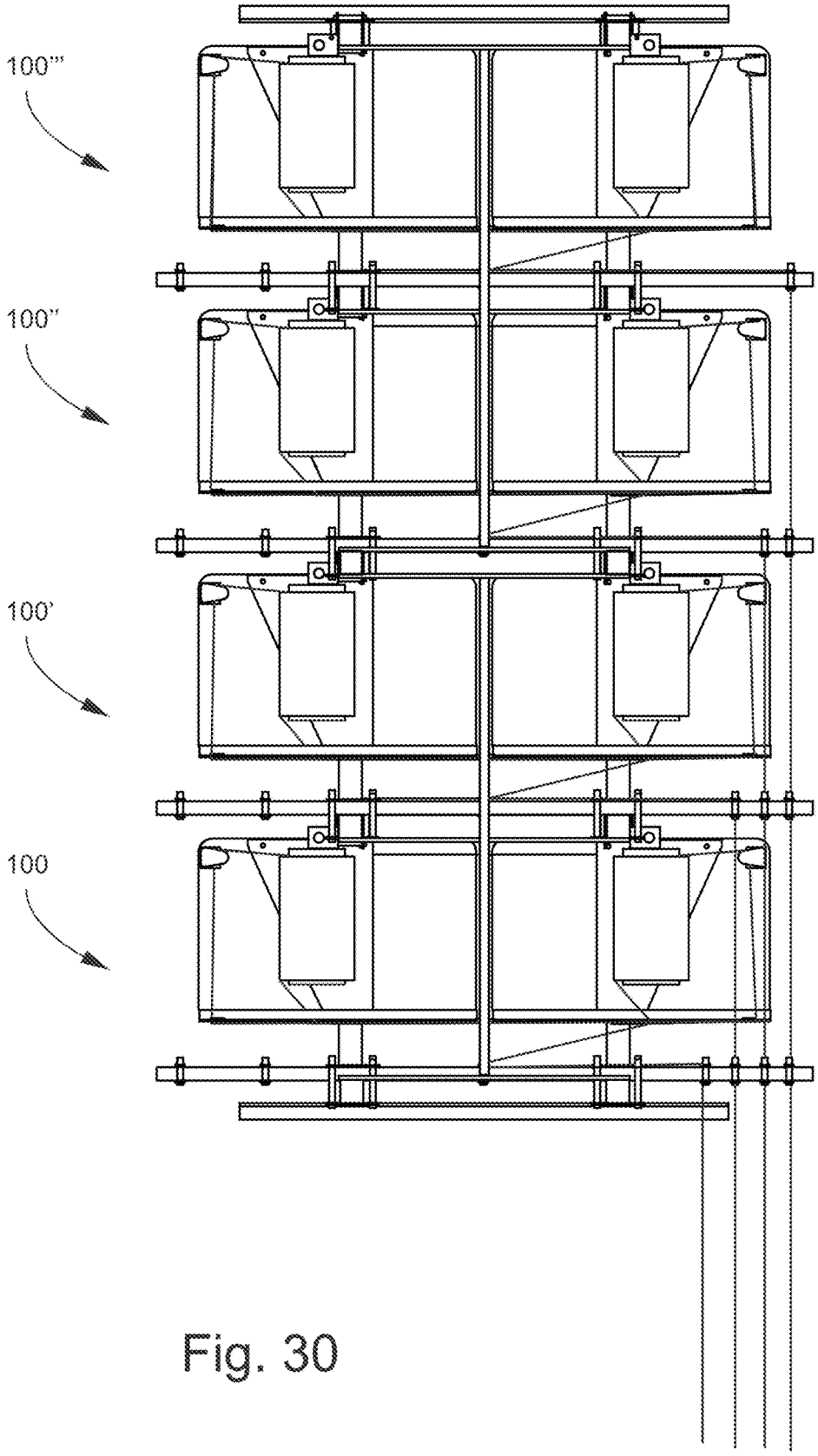

An alternative exemplary embodiment of the present creel assembly is illustrated in FIGS. 23-30. In this embodiment, a single creel assembly 100 incorporates two identical back-to-back vertical station columns—each column comprising four vertically-adjacent (e.g., stacked) package stations A-D. The package stations A-D are identical to those previously described. The yarn packages PA-PD carried in respective pairs of columns are all interconnected, and are interconnected from one station column to the other in the creel assembly 100 (as best shown in FIGS. 23 and 27). A single end of yarn Y1, Y2 runs from each cooperating pair of station columns in respective creel assemblies 100, 100'. A single support frame 110 may carry multiple pairs of side-by-side creel assemblies 100, 100', such as two assemblies illustrated in FIGS. 23-28, or may carry more than two (e.g., four) side-by-side creel assemblies 100, 100', 100", 100'" as illustrated in FIGS. 29 and 30.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A yarn creel assembly, comprising:

a vertical frame;

a plurality of vertically arranged package stations, each package station comprising:

i. an elongated package holder having a proximal end attached to said vertical frame and a distal end adapted for receiving and carrying a yarn package, whereby a tail end of one yarn package in a first package station is attached to a head end of another yarn package located in a second package station;

ii. a substantially horizontal planar station divider located between vertically adjacent package stations; and iii. a vertical wall adjacent said station divider and spaced apart from the distal end of said package holder, said vertical wall defining an arcuate yarn guide adapted for guiding a moving end of yarn drawn from an emptying yarn package in the first package station and transitioning to a full yarn package in the second package station, and wherein said arcuate yarn guide comprises a continuous slot having first and second end points, and wherein the first endpoint of said arcuate yarn guide is located forward of and below said package holder, and wherein the second end point is located rearward of and above said first end point.

2. A yarn creel assembly according to claim 1, and comprising a fixed-point yarn guide attached to said vertical wall proximate the first end point of said arcuate yarn guide.

3. A yarn creel assembly according to claim 2, and comprising a fixed-point yarn guide attached to said vertical wall proximate the second end point of said arcuate yarn guide.

4. A yarn creel assembly according to claim 3, wherein the second end point of said arcuate yarn guide is substantially linearly aligned with the distal end of said package holder.

5. A yarn creel assembly according to claim 1, and comprising a fixed-point yarn guide attached to said horizontal divider, and located forward of and below said package holder.

6. A yarn creel assembly according to claim 5, wherein the fixed-point yarn guide of said horizontal divider is substantially linearly aligned with the first end point of said arcuate yarn guide.

7. A yarn creel assembly according to claim 1, wherein said station divider is substantially transparent.

8. A yarn creel assembly according to claim 1, wherein said plurality of package stations comprises at least four vertically aligned package stations.

9. A yarn creel assembly according to claim 1, wherein said package holder is pivotably attached to said vertical frame, and adapted for movement between a 0-degree package ready position and a substantially 90-degree package replacement position.

* * * * *